US012059592B2

(12) United States Patent
Jones et al.

(10) Patent No.: US 12,059,592 B2
(45) **Date of Patent: *Aug. 13, 2024**

(54) EXERCISE BIKE

(71) Applicant: Coulter Ventures, LLC., Columbus, OH (US)

(72) Inventors: Dylan Jones, Santa Barbara, CA (US); Matt Dubberley, Santa Barbara, CA (US); Patrick Burgess, Asheville, NC (US)

(73) Assignee: Coulter Ventures, LLC., Columbus, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/930,862

(22) Filed: Sep. 9, 2022

(65) Prior Publication Data

US 2023/0110565 A1 Apr. 13, 2023

Related U.S. Application Data

(63) Continuation of application No. 17/200,052, filed on Mar. 12, 2021, now Pat. No. 11,439,866, which is a continuation of application No. 16/213,090, filed on Dec. 7, 2018, now Pat. No. 10,946,237, which is a continuation of application No. 16/045,475, filed on Jul. 25, 2018, now Pat. No. 10,155,132.

(Continued)

(51) Int. Cl.
*A63B 22/06* (2006.01)
*A63B 21/008* (2006.01)

(52) U.S. Cl.
CPC ..... *A63B 22/0605* (2013.01); *A63B 21/0088* (2013.01)

(58) Field of Classification Search
CPC ..... A63B 22/06–2022/0658; A63B 69/16–2069/168; A63B 21/0088
See application file for complete search history.

(56) References Cited

U.S. PATENT DOCUMENTS 4,188,030 A 2/1980 Hooper
D272,182 S 1/1984 Fowler et al.
(Continued)

FOREIGN PATENT DOCUMENTS

DE 202018006339 U1 1/2020
DE 202018006340 U1 1/2020
(Continued)

OTHER PUBLICATIONS

May 28, 2019—(WO) ISR & WO—App PCT/US2018/066059.
(Continued)

*Primary Examiner* — Jennifer Robertson
(74) *Attorney, Agent, or Firm* — Banner & Witcoff, Ltd.

(57) ABSTRACT

An exercise bike includes a frame, a rotor assembly and a drive assembly mounted on the frame, where the drive assembly is configured to drive rotation of the rotor assembly, and a cover configured to at least partially cover the rotor assembly. The components of the drive assembly and the rotor assembly include structures that improve the performance of the exercise bike, including but not limited to a strong and rigid construction and improvements in belt tracking, user feel, effort consistency, synchronization, and rotor performance.

20 Claims, 30 Drawing Sheets

Related U.S. Application Data

(60) Provisional application No. 62/663,090, filed on Apr. 26, 2018.

(56) References Cited

U.S. PATENT DOCUMENTS

| | | | | |
|---|---|---|---|---|
| D292,304 | S | 10/1987 | Ostrom | |
| 4,712,789 | A | 12/1987 | Brilando | |
| 4,712,790 | A | 12/1987 | Szymski | |
| 4,824,102 | A | 4/1989 | Lo | |
| 4,880,225 | A | 11/1989 | Lucas et al. | |
| 4,889,335 | A | 12/1989 | Chen | |
| D306,330 | S | 2/1990 | Lucas et al. | |
| D307,167 | S | 4/1990 | Lucas et al. | |
| 4,917,376 | A | 4/1990 | Lo | |
| D307,614 | S | 5/1990 | Bingham et al. | |
| D307,615 | S | 5/1990 | Bingham et al. | |
| 4,932,649 | A | 6/1990 | Chen | |
| 4,961,569 | A | 10/1990 | Roberge | |
| 4,961,570 | A | 10/1990 | Chang | |
| 4,962,925 | A | 10/1990 | Chang | |
| 4,971,316 | A | 11/1990 | Dalebout et al. | |
| 4,981,294 | A | 1/1991 | Dalebout et al. | |
| 5,000,444 | A | 3/1991 | Dalebout et al. | |
| D319,274 | S | 8/1991 | Byrd et al. | |
| D319,480 | S | 8/1991 | Byrd et al. | |
| D319,675 | S | 9/1991 | Byrd et al. | |
| 5,048,824 | A | 9/1991 | Chen | |
| 5,149,312 | A | 9/1992 | Croft et al. | |
| D330,236 | S | 10/1992 | Jarriel et al. | |
| D333,868 | S | 3/1993 | Yaung | |
| RE34,478 | E | 12/1993 | Dalebout et al. | |
| D344,583 | S | 2/1994 | Hsu | |
| 5,290,212 | A | 3/1994 | Metcalf | |
| 5,346,445 | A | 9/1994 | Chang | |
| 5,397,286 | A | 3/1995 | Chang | |
| 5,443,434 | A * | 8/1995 | Buchanan | A63B 22/001 482/111 |
| 5,795,270 | A | 8/1998 | Woods et al. | |
| D418,218 | S | 12/1999 | Hsu | |
| 6,159,132 | A | 12/2000 | Chang | |
| 6,220,991 | B1 | 4/2001 | Sellers | |
| D459,796 | S | 7/2002 | Moreno | |
| D465,818 | S | 11/2002 | Goldberg | |
| D473,274 | S | 4/2003 | Baudhuin et al. | |
| D473,602 | S | 4/2003 | Baudhuin et al. | |
| D474,252 | S | 5/2003 | Lull et al. | |
| D488,861 | S | 4/2004 | Moreno | |
| D503,472 | S | 3/2005 | Tai | |
| D503,474 | S | 3/2005 | Tai | |
| 6,881,178 | B1 | 4/2005 | Goldberg | |
| D507,313 | S | 7/2005 | Goldberg | |
| D516,208 | S | 2/2006 | Tai | |
| 7,175,570 | B2 | 2/2007 | Lull et al. | |
| D636,449 | S | 4/2011 | Wu | |
| D645,134 | S | 9/2011 | Lee et al. | |
| D654,134 | S | 2/2012 | Edge et al. | |
| D677,351 | S | 3/2013 | Baudhuin | |
| D677,747 | S | 3/2013 | Baudhuin et al. | |
| D679,765 | S | 4/2013 | Baudhuin et al. | |
| D699,305 | S | 2/2014 | Rauwerdink | |
| D699,795 | S | 2/2014 | Rauwerdink | |
| D699,796 | S | 2/2014 | Flick et al. | |
| D700,668 | S | 3/2014 | Flick et al. | |
| D709,566 | S | 7/2014 | Baudhuin | |
| D709,567 | S | 7/2014 | Baudhuin et al. | |
| D756,500 | S | 5/2016 | Rasmussen | |
| D767,049 | S | 9/2016 | Flick et al. | |
| D767,050 | S | 9/2016 | Flick et al. | |
| D767,051 | S | 9/2016 | Flick et al. | |
| D781,385 | S | 3/2017 | Flick et al. | |
| D781,971 | S | 3/2017 | Hsieh | |
| D806,223 | S | 12/2017 | Allard et al. | |
| 9,889,336 | B1 | 2/2018 | Chen | |
| D834,174 | S | 11/2018 | Fuselier | |
| 10,155,132 | B2 * | 12/2018 | Jones | A63B 21/154 |
| D850,603 | S | 6/2019 | Wang | |
| D852,905 | S | 7/2019 | Flick | |
| D856,445 | S | 8/2019 | Jones | |
| D858,663 | S | 9/2019 | Jones et al. | |
| D861,809 | S | 10/2019 | Jones et al. | |
| D870,829 | S | 12/2019 | Jones et al. | |
| D873,305 | S | 1/2020 | Thooft et al. | |
| D873,405 | S | 1/2020 | McRoberts | |
| D890,275 | S | 7/2020 | Jones et al. | |
| 10,946,237 | B2 * | 3/2021 | Jones | A63B 22/001 |
| 11,439,866 | B2 * | 9/2022 | Jones | A63B 22/0046 |
| D980,929 | S | 3/2023 | Jones et al. | |
| 2007/0179025 | A1 | 8/2007 | Tsai | |
| 2012/0065029 | A1 | 3/2012 | Dunlap | |
| 2017/0274238 | A1 * | 9/2017 | Chou | A63B 21/0088 |
| 2018/0064982 | A1 | 3/2018 | Chen | |
| 2018/0256932 | A1 * | 9/2018 | Hsu | A63B 23/03525 |
| 2018/0326257 | A1 | 11/2018 | Jones et al. | |

FOREIGN PATENT DOCUMENTS

| | | | | |
|---|---|---|---|---|
| DE | 112018007510 | T5 | 3/2021 | |
| DE | 202018006580 | U1 | 6/2021 | |
| EM | 001622945-0005 | | 10/2009 | |
| EM | 001622945-0007 | | 10/2009 | |
| EM | 002248963-0001 | | 7/2013 | |
| EM | 002248963-0003 | | 7/2013 | |
| EM | 002746099-0002 | | 8/2015 | |
| EP | 2237864 | A1 | 10/2010 | |
| WO | 2012030233 | A1 | 3/2012 | |
| WO | WO-2012030233 | A1 * | 3/2012 | A63B 21/0088 |
| WO | 2015093982 | A1 | 6/2015 | |
| WO | 2019209383 | A1 | 10/2019 | |

OTHER PUBLICATIONS

Sep. 7, 2022—(BR) Office Action—App BR112020021900-2.
Rogue Echo Bike product advertisement from https://www.youtube.com/watch?v=9xfUu652CMg>, dated Dec. 26, 2017.
Rogue Echo Bike product advertisement from <https://www.instagram.com/p/BdLUs0LIf7u/?hl=en>, dated Dec. 26, 2017.
Rogue Echo Bike product listing from <https://www.roguefitness.com/rogue-echo-bike>, dated Sep. 13, 2018.
Schwinn Airdyne Pro product advertisement from <https://www.youtube.com/watch?v=c4t_XRTzwPk>, dated Nov. 17, 2015.
Schwinn Airdyne Pro product listing from <https://www.roguefitness.com/schwinn-airdyne-pro>, dated Sep. 13, 2018.
Schwinn Airdyne AD6 product listing from <https://www.schwinnfitness.com/ad6/100250.html?adID=SDOSG2SSL4&gclid=EAlalQobChMI2JjUhOa43QIVyh-GCh1j5wPmEAAYAiAAEgJJ7fD_BwE&gclsrc=aw.ds&psearch=1>, dated Sep. 13, 2018.
Concept2 BikeERG product advertisement from <https://www.youtube.com/watch?v=nq9fnKhJMgg>, dated Sep. 1, 2017.
Concept2 BikeERG product listing from <https://www.concept2.com/bikeerg/concept2-bikeerg>, dated Sep. 13, 2018.
Concept2 BikeERG product listing from <https://www.roguefitness.com/concept2-bike-erg>, dated Sep. 13, 2018.
Assault Airbike product listing from <https://www.roguefitness.com/assault-airbike-and-accessories>, dated Sep. 13, 2018.
Assault Airbike product photos from <https://www.assaultfitness.com/products/airbike-classic>, dated Sep. 13, 2018.
Assault Airbike product advertisement from <https://www.youtube.com/watch?v=uvgwUrD8W6w>, dated Feb. 9, 2015.
Assault Airbike Elite product advertisement from <https://www.youtube.com/watch?v=YdSAtaj5xWw>, dated Nov. 21, 2017.
Assault Airbike Elite product photos from <https://www.assaultfitness.com/products/airbike-elite>, dated Sep. 13, 2018.
"Assault Air Bike Owner's Manual", Assault Air Bike, p. 1-24, published 2013 (24 pages).
"Chaimberg RXM Air Bike—Gronk Fitness Edition"; Gronk Fitness; retrieved Feb. 10, 2021; currently believed to be publicly disclosed as early as Jul. 2018; URL: <<https://www.gronkfitnessproducts.com/products/chaimberg-rxm-air-bike-gronk-fitness-edition>>.

(56) References Cited

OTHER PUBLICATIONS

"ProForm XP Whirlwind 320 Exercise Bike, Review"; Exercise Bike Zone; retrieved Feb. 10, 2021; published Sep. 9, 2014; URL: <<https://exercisebikezone.blogspot.com/2014/09/proform-xp-whirlwind-320-exercise-bike.html>>.
"Marcy Fan Bike | NS-1000"; Marcy; retrieved Feb. 10, 2021; publicly disclosed as early as Dec. 29, 2015; URL: <<https://www.marcypro.com/marcy-fan-bike-ns-1000>>.
"Schwinn Airdyne AD2 Dual Action Air Cycle"; Fitness Superstore; retrieved Feb. 10, 2021; publicly disclosed as early as Dec. 19, 2017; URL: <<https://www.fitness-superstore.co.uk/schwinn-airdyne-ad2-dual-action-air-cycle-1.html>>.
"Schwinn Airdyne AD8"; Schwinn Fitness; retrieved Feb. 10, 2021; publicly disclosed as early as Dec. 18, 2015; URL: <<https://global.schwinnfitness.com/en/ad8/100475.html>>.
"Xebex Air Bike"; Xebex Fitness; retrieved Feb. 10, 2021; publicly disclosed as early as May 28, 2016; URL: <<http://xebexfitness.com/xebexairbike.html>>.
"{OVERVIEW] Schwinn AD2 Airdyne Exercise Bike 2014 Edition!"; Youtube; retrieved Mar. 12, 2021; published Jan. 28, 2014; URL: <<https://www.youtube.com/watch?v=8QWFa0wuLRU>>.
Pictures of Schwinn Air-Dyne Exerciser , by Schwinn Bicycle Company, 1 color sheet of photographs, publicly disclosed no later than Dec. 31, 1981.
Catalog for "Schwinn Bicycles and Accessories 1980", Schwinn Bicycle Company, p. 50-57, published 1980 (8 pages).
Screenshot of Assault Airbike from www.rogueeurope.eu, using the website "waybackmachine" https://web.archive.org/web/2016041602458/http://www.rogueeurope.eu/assault-air-bike-eu, dated Apr. 16, 2016, accessed Jun. 2, 2020.
Screenshot of Assault Airbike from https://www.youtube.com/watch?v=415bFWoX4go, dated Aug. 27, 2014, accessed Jun. 2, 2020.
Screenshot of Schwinn Airdyne Ad Pro Bike from www.rogueeurope.eu, using the website "waybackmachine" https://web.archive.org/web/20160319150010/http://www.roguefitness.com/schwinn-airdyne-ad-pro, dated Mar. 19, 2016, accessed Jun. 2, 2020.
Screenshot of GetRxd Xebex Fitness Air Bike from https://www.youtube.com/watch?v=EXOBMBRzBFg, dated May 30, 2016. accessed Jun. 2, 2020.
Screenshot of 'Owner's manual' for Assault AirBike from https://www.360fitnesssuperstore.com/pdf/fitness-equipment-manuals/Assault/Assault-AirBike-Owners-Manual.pdf, dated Sep. 2013, accessed Jun. 2, 2020.
Screenshot of Xebex Airbike from https://www.youtube.com/watch?v=5bUOd9W6iP4, dated Oct. 17, 2015, accessed Jun. 2, 2020.
Screenshot of Proform XP Whirlwind 280 Bike from https://www.youtube.com/watch?v=jiFijZFfGEA, dated Apr. 4, 2012, accessed Jun. 2, 2020.
Screenshot of Assault Airbike from https://www.youtube.com/watch?v=x4Lo-0eeLbM, dated May 8, 2016, accessed Jul. 2, 2020.
Screenshot of Elite Assault Bike from https://www.youtube.com/watch?v=5fkK60ZLDAQ, dated Sep. 4, 2017, accessed Jul. 2, 2020.
Screenshot from Club Industry article showing release of Elite Assault Bike from https://www.clubindustry.com/news-central/two-new-assault-fitness-products-hit-gym-floor, dated Jun. 21, 2017, accessed Jul. 2, 2020.
Screenshot of Airdyne AD2 from https://www.youtube.com/watch?v=5fkK60ZLDAQ, dated Feb. 18, 2017, accessed Jul. 2, 2020.
Screenshot of Airmill Air Bike from https://www.youtube.com/watch?v=DI6ijl34q-8, dated Apr. 17, 2017, accessed Jul. 2, 2020.
Screenshot of Gronnk Fitness Chaimberg RXM from https://www.youtube.com/watch?v=Q9DgiDc4yro, dated Apr. 20, 2018, accessed Jul. 2, 2020.
Screenshot of JLL Sonic 1 Airbike unboxing from https://www.youtube.com/watch?v=MOH6mQKU-_Y, dated Mar. 8, 2019, accessed Jul. 2, 2020.
Website link to history of exercise bikes released by Mad Dog Athletics, ttps://www.maddogg.com/history.html, accessed Jul. 2, 2020.
Screenshot of Bulldog Gear Airbike 1.0 from https://www.youtube.com/watch?v=MOH6mQKU-_Y, dated Mar. 8, 2019, accessed Jul. 2, 2020.
Screenshot showing sale of Bulldog Gear Airbike 1.0 from www.bulldoggear.eu using the website "waybackmachine" web.archive.org/web/20161208114845/http://www.bulldoggear.eu/collections/conditioning/products/bulldog-gear-airbike, dated Dec. 8, 2016, accessed Jul. 2, 2020.
Design View of Registered Community Design No. 002746099-0002, dated Jul. 30, 2015.
Design View of Registered Community Design No. 002248963-0001, dated Jun. 4, 2013.
Design View of Registered Community Design No. 002248963-0003, dated Jun. 4, 2013.
Screenshot from LlifeFitness article "50 Years Ago This Groundbreaking Indoor Cycle Changed Fitness" from https://www.lifefitness.com/en-us/blog/50-years-ago-groundbreaking-indoor-cycle-changed-fitness, accessed Feb. 10, 2021.
Screenshot of Assault AirBike Classic from https://www.amazon.com/Assault-Fitness-Air-Bike-AirBike/dp/B00F74RX40, publicly disclosed as early as Nov. 1, 2013, accessed Feb. 10, 2021.
Screenshot of Assault Fitness AirBike Classic from https://www.titaniumstrength.co.uk/assault-fitness-airbike-classic.html?gclid=EAlalQobChMitOjr9fPB7gIVqejtCh2ykwqrEAQYAyABEgLiLPDBwE, publically disclosed as early as Nov. 1, 2013, accessed Feb. 10, 2021.
Screenshot of Assault Bike Elite from https://www.assaultfitness.com/products/airbike-elite, accessed Feb. 10, 2021.
Canadian Industrial Design Patent No. CA65213 full patent report.
Design View of Registered Community Design No. 00020557-0004, dated Apr. 9, 2003, accessed Feb. 2, 2021.
Design View of Registered Community Design No. 000077219-0001, dated Sep. 19, 2003, accessed Mar. 18, 2021.
Design View of Registered Community Design No. 000134168-0004, dated Jan. 27, 2004, accessed Feb. 17, 2021.
Design View of Registered Community Design No. 000150552-0002, dated Mar. 9, 2004, accessed Feb. 17, 2021.
Design View of Registered Community Design No. 000467337-0001, dated Jan. 18, 2006, accessed Feb. 17, 2021.
Design View of Registered Community Design No. 001135206-0005, dated May 6, 2009, accessed Feb. 17, 2021.
Design View of Registered Community Design No. 00118093-0001, dated Nov. 23, 2009, accessed, Mar. 18, 2021.
Design View of Registered Community Design No. 001202550-0004, dated Apr. 23, 2010, accessed, Mar. 18, 2021.
Design View of Registered Community Design No. 001563719-0005, dated Jun. 29, 2009, accessed, Mar. 18, 2021.
Design View of Registered Community Design No. 002280453-0001, dated Jul. 24, 2013, accessed, Feb. 17, 2021.
Design View of Registered Community Design No. 002453753-0001, dated Apr. 28, 2014, accessed, Mar. 18, 2021.
Design View of Registered Community Design No. 002773523-0002, dated Sep. 16, 2015, accessed, Mar. 18, 2021.
Design View of Registered Community Design No. 003017870-0002, dated Mar. 7, 2016, accessed, Mar. 18, 2021.
Design View of Registered Community Design No. 003450626-0003, dated Nov. 7, 2016, accessed, Mar. 18, 2021.
EUIPO search of Registered Community Design No. 000020557-0004, accessed, Feb. 10, 2021.
EUIPO search of Registered Community Design No. 000134168-0004, accessed, Feb. 10, 2021.
EUIPO search of Registered Community Design No. 000150552-0002, accessed, Feb. 10, 2021.
EUIPO search of Registered Community Design No. 000467337-0001, accessed, Feb. 10, 2021.
EUIPO search of Registered Community Design No. 001135206-0005, accessed, Feb. 10, 2021.
EUIPO search of Registered Community Design No. 001622945-0005, accessed, Feb. 10, 2021.
EUIPO search of Registered Community Design No. 001622945-0007, accessed, Feb. 10, 2021.
EUIPO search of Registered Community Design No. 002248963-0001, accessed, Feb. 10, 2021.

(56) References Cited

OTHER PUBLICATIONS

EUIPO search of Registered Community Design No. 002248963-0003, accessed, Feb. 10, 2021.
EUIPO search of Registered Community Design No. 002280453-0001, accessed, Feb. 10, 2021.
EUIPO search of Registered Community Design No. 002746099-0002, accessed, Feb. 10, 2021.
Screenshot of Rogue Echo Bike from https://www.rogueeurope.eu/rogue-echo-bike-eu, publicly disclosed no later than Apr. 7, 2019, accessed Feb. 10, 2021.
Screenshot of Garage Gym Reviews showing the Xebex Airmill Air Bike from https://www.garagegymreviews.com/xebex-airmill-air-bike, earliest known date Aug. 9, 2020, accessed Feb. 10, 2021.
*Coulter Ventures LLC* v. *Bulldog Gear Limited, UK High Court* (*Eng. & Wales*), Claim No. HP-2019-000054, Defence and Counterclaim, dated Feb. 13, 2020.
*Coulter Ventures LLC* v. *Bulldog Gear Limited, UK High Court* (*Eng. & Wales*), Claim No. HP-2019-000054, Defendant's Initial Disclosure List of Documents, dated Feb. 12, 2020.
*Coulter Ventures LLC* v. *Bulldog Gear Limited, UK High Court* (*Eng. & Wales*), Claim No. HP-2019-000054, Amended Defence and Counterclaim, dated Apr. 23, 2020.
*Coulter Ventures LLC* v. *Bulldog Gear Limited, UK High Court* (*Eng. & Wales*), Claim No. HP-2019-000054, Amended Defendant's Initial Disclosure List of Documents, dated Apr. 23, 2020.
*Coulter Ventures LLC* v. *Bulldog Gear Limited, UK High Court* (*Eng. & Wales*), Claim No. HP-2019-000054, Re-Amended Defence and Counterclaim, dated Feb. 4, 2021.
*Coulter Ventures LLC* v. *Bulldog Gear Limited, UK High Court* (*Eng. & Wales*), Claim No. HP-2019-000054, Claim Form and Particulars of Claim, dated Dec. 18, 2019.
*Coulter Ventures LLC* v. *Bulldog Gear Limited, UK High Court* (*Eng. & Wales*), Claim No. HP-2019-000054, Claimant's Initial Disclosure List of Documents, dated Dec. 18, 2019.
*Coulter Ventures LLC* v. *Bulldog Gear Limited, UK High Court* (*Eng. & Wales*), Claim No. HP-2019-000054, Reply and Defence to Counterclaim, dated Apr. 2, 2020.
*Coulter Ventures LLC* v. *Bulldog Gear Limited, UK High Court* (*Eng. & Wales*), Claim No. HP-2019-000054, Amended Claim Form and Amended Particulars of Claim, dated Dec. 23, 2020.
*Coulter Ventures LLC* v. *Bulldog Gear Limited, UK High Court* (*Eng. & Wales*), Claim No. HP-2019-000054, Amended Reply and Defence to Counterclaim, dated Feb. 18, 2021.
Sep. 11, 2023—(BR) Written Opinion—App BR112020021900-2.
Jan. 3, 2023—(CA) Office Action—App 3,098,432.
Aug. 17, 2023—(CA) 3rd Office Action—App 3,098,432.
Jun. 19, 2024—(AU) Examination Report—App 2023202730.

* cited by examiner

EXERCISE BIKE

CROSS REFERENCE TO RELATED APPLICATION

The present application is a continuation of U.S. patent application Ser. No. 17/200,052, filed Mar. 12, 2021, which is a continuation of U.S. patent application Ser. No. 16/213,090, filed Dec. 7, 2018, granted as U.S. Pat. No. 10,946,237, issued on Mar. 16, 2021, which is a continuation of U.S. patent application Ser. No. 16/045,475, filed Jul. 25, 2018, granted as U.S. Pat. No. 10,155,132, issued on Dec. 18, 2018, which is a non-provisional of U.S. Provisional Application No. 62/663,090, filed Apr. 26, 2018, and the present application claims priority to all of such prior applications, which are hereby incorporated by reference in their entireties.

FIELD OF THE INVENTION

This disclosure relates to exercise bikes, and more specifically to exercise bikes having features that provide improved energy efficiency, enhanced feel, and increased durability, among other benefits.

BACKGROUND

Exercise bikes and other exercise equipment that use human exertion to drive rotation of a rotor to provide resistance for exercise purposes are common and known in the art. Such equipment can be provided in a wide variety of configurations, with many different features. However, existing equipment of this type also suffers from many drawbacks, and a need exists for improvements. For example, many existing exercise bikes have structures that do not provide rigid construction, smooth and consistent user effort, or close synchronization between components during use, leading to an overall "feel" that is unsatisfactory for many users. This unsatisfactory "feel" is particularly important in equipment that may be used repeatedly, even daily or more frequently by some users. The present disclosure addresses these and other problems with existing exercise bikes and other exercise equipment.

BRIEF SUMMARY

General aspects of the present disclosure relate to an exercise bike or other article of exercise equipment that has a supporting frame, a rotor supported by the frame, and a drive system that drives rotation of the rotor.

Aspects of the disclosure relate to an exercise bike that includes a frame configured to rest on a ground surface and having a seat configured to support a user, a rotor supported by the frame, and a drive assembly operably connected to the rotor to drive rotation of the rotor. The rotor includes a hub supported by the frame for rotation on a first axis and a plurality of blades connected to the hub, where the hub and the plurality of blades are configured to rotate together about the first axis. The plurality of blades includes a first blade having a proximal end connected to the hub and an elongated body extending outward in a longitudinal direction from the hub to a distal end, with the elongated body having upper and lower surfaces and opposed first and second edges extending between the proximal and distal ends. The first blade also includes a first flange connected to the body and extending from the body transverse to the upper and lower surfaces. The other blades may have the same structure as the first blade in one configuration. The drive assembly includes a pulley assembly supported by the frame operably connected to the rotor, and a pedal assembly and an arm assembly operably connected to the pulley assembly to drive rotation of the rotor through the pulley assembly.

According to one aspect, the first flange of the first blade extends along the first edge for an entire length of the first edge in the longitudinal direction, and the first blade further includes a second flange that extends along the second edge for an entire length of the second edge in the longitudinal direction.

According to another aspect, the first flange extends downward from the body of the first blade and forms a 90° angle with the body at a junction between the body and the first flange.

According to a further aspect, the first flange has a first height that is greater at the proximal end and smaller at the distal end. The first blade may also include a second flange having a second height that is greater at the proximal end and smaller at the distal end. In one configuration, the first height and/or the second height decreases continuously from the proximal end to the distal end. In another configuration, the first flange extends along the first edge of the first blade, and the second flange extends transverse to the upper and lower surfaces along the second edge.

According to yet another aspect, the first flange extends along the first edge of the first blade, and the first blade further includes a second flange extending transverse to the upper and lower surfaces along the second edge. The first flange has a first extension extending outward in the longitudinal direction from the proximal end of the body to form a first mount that is contiguous with the first flange, and the second flange has a second extension extending outward in the longitudinal direction from the proximal end of the body to form a second mount that is contiguous with the second flange, where the first and second mounts are connected to the hub to connect the first blade to the hub.

According to a still further aspect, the body of the first blade includes an upper portion extending in the longitudinal direction at a center area of the first blade, a first lower portion extending in the longitudinal direction along the first edge, and a second lower portion extending in the longitudinal direction along the second edge. The upper portion is vertically offset from the first and second lower portions, and the body of the first blade further includes a first step portion extending downward from the upper portion to the first lower portion and a second step portion extending downward from the upper portion to the second lower portion.

According to another aspect, a width of the first blade, measured between the first and second edges, is constant from the proximal end to the distal end.

According to an additional aspect, the first blade has a first engagement surface spaced from a connection point between the first mount and the hub, and the hub has a complementary engagement surface that engages the first engagement surface of the first blade to resist pivoting of the first blade about the connection point. In one configuration, the first engagement surface is located on an end of the first mount, and the complementary engagement surface is formed by a projection on the hub that abuts the first engagement surface.

Additional aspects of the disclosure relate to an exercise bike that includes a frame configured to rest on a ground surface and having a seat configured to support a user, a rotor supported by the frame, and a drive assembly operably connected to the rotor to drive rotation of the rotor. The rotor includes a hub supported by the frame for rotation on a first axis and a plurality of blades connected to the hub, where the hub and the plurality of blades are configured to rotate together about the first axis. The plurality of blades includes a first blade having a proximal end connected to the hub and an elongated body extending outward in a longitudinal direction from the hub to a distal end, with the elongated body having upper and lower surfaces and two edges extending between the proximal and distal ends. The body of the first blade includes an upper portion extending in the longitudinal direction at a center area of the first blade, a first lower portion extending in the longitudinal direction along the first edge, and a second lower portion extending in the longitudinal direction along the second edge. The upper portion is vertically offset from the first and second lower portions, and the body of each blade further includes a first step portion extending downward from the upper portion to the first lower portion and a second step portion extending downward from the upper portion to the second lower portion. The other blades may have the same structure as the first blade in one configuration. The drive assembly includes a pulley assembly supported by the frame operably connected to the rotor, and a pedal assembly and an arm assembly operably connected to the pulley assembly to drive rotation of the rotor through the pulley assembly.

According to one aspect, the upper portion, the first lower portion, and the second lower portion of the first blade are generally planar and parallel to each other, and the first lower portion and the second lower portion of the first blade are coplanar.

According to another aspect, the upper portion of the first blade is also offset laterally from the first lower portion and the second lower portion, and the first and second step portions extend laterally outward and downward from the upper portion to the first and second lower portions. In one configuration, the first and second step portions form angles with the upper portion of 120°-140°.

According to a further aspect, a degree of vertical offset between the upper portion and the first and second lower portions of the first blade is greater than a thickness of the first blade measured between the upper and lower surfaces.

According to yet another aspect, the first blade has a first mount extending outward in the longitudinal direction from the proximal end along the first edge and a second mount extending outward in the longitudinal direction from the proximal end along the second edge.

According to a still further aspect, the upper portion, the first and second lower portions, and the first and second step portions extend from the proximal end to the distal end of the first blade.

Further aspects of the disclosure relate to an exercise bike that includes a frame configured to rest on a ground surface and having a seat configured to support a user, a rotor supported by the frame, and a drive assembly operably connected to the rotor to drive rotation of the rotor. The rotor includes a hub supported by the frame for rotation on a first axis, a sprocket operably connected to the hub, a plurality of blades connected to the hub, and a plurality of connectors connecting the blades to the hub, such that the hub, the sprocket, and the plurality of blades are configured to rotate together about the first axis. The plurality of blades includes a first blade having a proximal end connected to the hub and an elongated body extending outward from the hub to a distal end, with the elongated body having upper and lower surfaces and two edges extending between the proximal and distal ends. In this configuration, 70-90% of a weight of the rotor is located within 75% of a maximum diameter of the rotor. The other blades may have the same structure as the first blade in one configuration. The drive assembly includes a pulley assembly supported by the frame operably connected to the sprocket of the rotor, and a pedal assembly and an arm assembly operably connected to the pulley assembly to drive rotation of the rotor through the pulley assembly.

According to one aspect, 50-70% of the weight of the rotor is located within 50% of the maximum diameter of the rotor and/or 30-50% of the weight of the rotor is located within 25% of the maximum diameter of the rotor.

According to another aspect, the hub and the connectors connecting the blades to the hub form a sole support structure for the blades, such that the distal ends of the blades are free ends that are not connected to any structure.

According to a further aspect, the first blade has a leading surface that includes all surfaces of the first blade facing into a direction of forward rotation of the rotor, and wherein the leading surface of the first blade has a surface area of at least 20 square inches, or a surface area of 20-40 square inches.

According to yet another aspect, the plurality of blades includes 8-12 blades and has a total weight of 9-11 pounds.

According to a still further aspect, a 38-56% portion of a total moment of inertia of the rotor is located within 75% of the maximum diameter of the rotor.

According to an additional aspect, the first blade has a cross-sectional area taken perpendicular to the longitudinal direction that decreases in the longitudinal direction along at least a portion of a length of the first blade between the proximal end and the distal end.

According to another aspect, the first blade has an incremental mass that decreases in the longitudinal direction along at least a portion of a length of the first blade between the proximal end and the distal end.

Still further aspects of the disclosure relate to an exercise bike that includes a frame configured to rest on a ground surface and having a seat configured to support a user, a rotor supported by the frame, and a drive assembly operably connected to the rotor to drive rotation of the rotor. The rotor includes a hub supported by the frame for rotation on a first axis, a sprocket operably connected to the hub, and a plurality of blades connected to the hub, where the hub, the sprocket, and the plurality of blades are configured to rotate together about the first axis. The plurality of blades includes a first blade having a proximal end connected to the hub and an elongated body extending outward in a longitudinal direction from the hub to a distal end, with the body having upper and lower surfaces and opposed first and second edges extending between the proximal and distal ends. The first blade also includes a first flange extending downwardly and transverse to the upper and lower surfaces along the first edge in the longitudinal direction and a second flange extending downwardly and transverse to the upper and lower surfaces along the second edge in the longitudinal direction. The first flange has a first extension extending outward in the longitudinal direction from the proximal end of the body to form a first mount that is contiguous with the first flange, and the second flange has a second extension extending outward in the longitudinal direction from the proximal end of the body to form a second mount that is contiguous with the second flange. The first and second mounts are each connected to the hub by one or more connectors. The drive assembly includes a pulley assembly including an input pulley supported by the frame for rotation on a second axis spaced from the first axis and a belt connected to the input pulley and the sprocket of the rotor to transfer power from the input pulley to the sprocket, as well as a pedal assembly and an arm assembly. The pedal assembly includes a pair of pedals operably connected to the input pulley to drive rotation of the input pulley, and the arm assembly includes a pair of reciprocating arms operably connected to the input pulley to drive rotation of the input pulley, such that the pedal assembly and the arm assembly are configured to drive rotation of the rotor through the input pulley, the belt, and the sprocket.

According to one aspect, 70-90% of a weight of the rotor is located within 75% of a maximum diameter of the rotor, 50-70% of the weight of the rotor is located within 50% of the maximum diameter of the rotor, and 30-50% of the weight of the rotor is located within 25% of the maximum diameter of the rotor, and the leading surface of each blade has a surface area of 20-40 square inches.

According to another aspect, the exercise bike further includes a rotor cover at least partially covering the rotor such that the rotor is configured to rotate within the rotor cover while permitting air passage to and from the rotor. The rotor cover includes a front piece forming a front half of the rotor cover, an upper rear piece forming an upper rear quarter of the rotor cover, and a lower rear piece forming a lower rear quarter of the rotor cover, such that the front piece, the upper rear piece, and the lower rear piece are connected together to form the rotor cover.

According to a further aspect, the first blade has a first engagement surface located on the first mount and spaced from a first connection point between the first mount and the hub and a second engagement surface located on the second mount and spaced from a second connection point between the second mount and the hub, and the hub has first and second complementary engagement surfaces that engage the first and second engagement surfaces of the first blade to resist pivoting of the first blade about the first and second connection points.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

DETAILED DESCRIPTION

Figure 1:
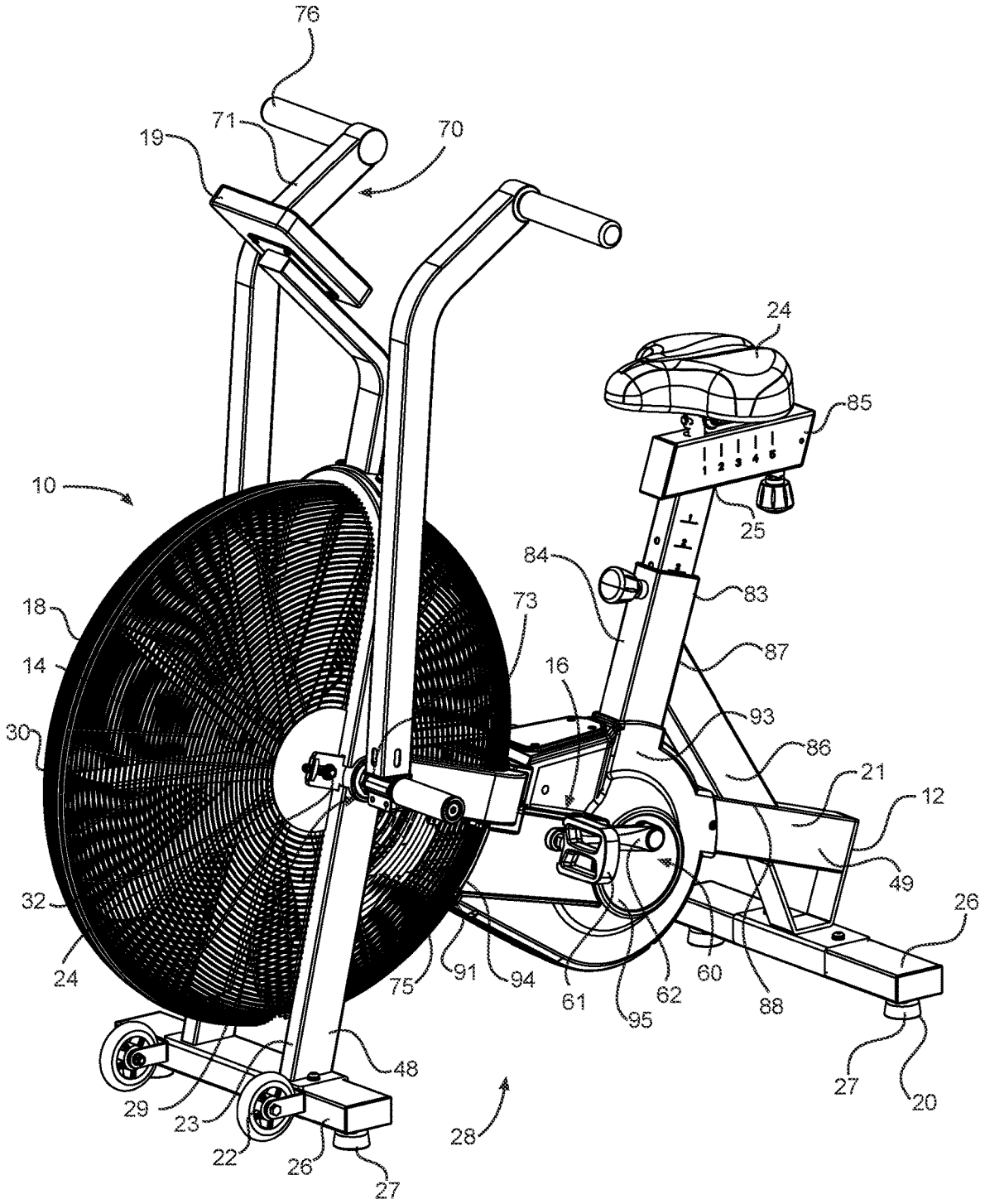
FIG. 1 is a top front perspective view of one embodiment of an exercise bike according to aspects of the disclosure.
Figure 2:
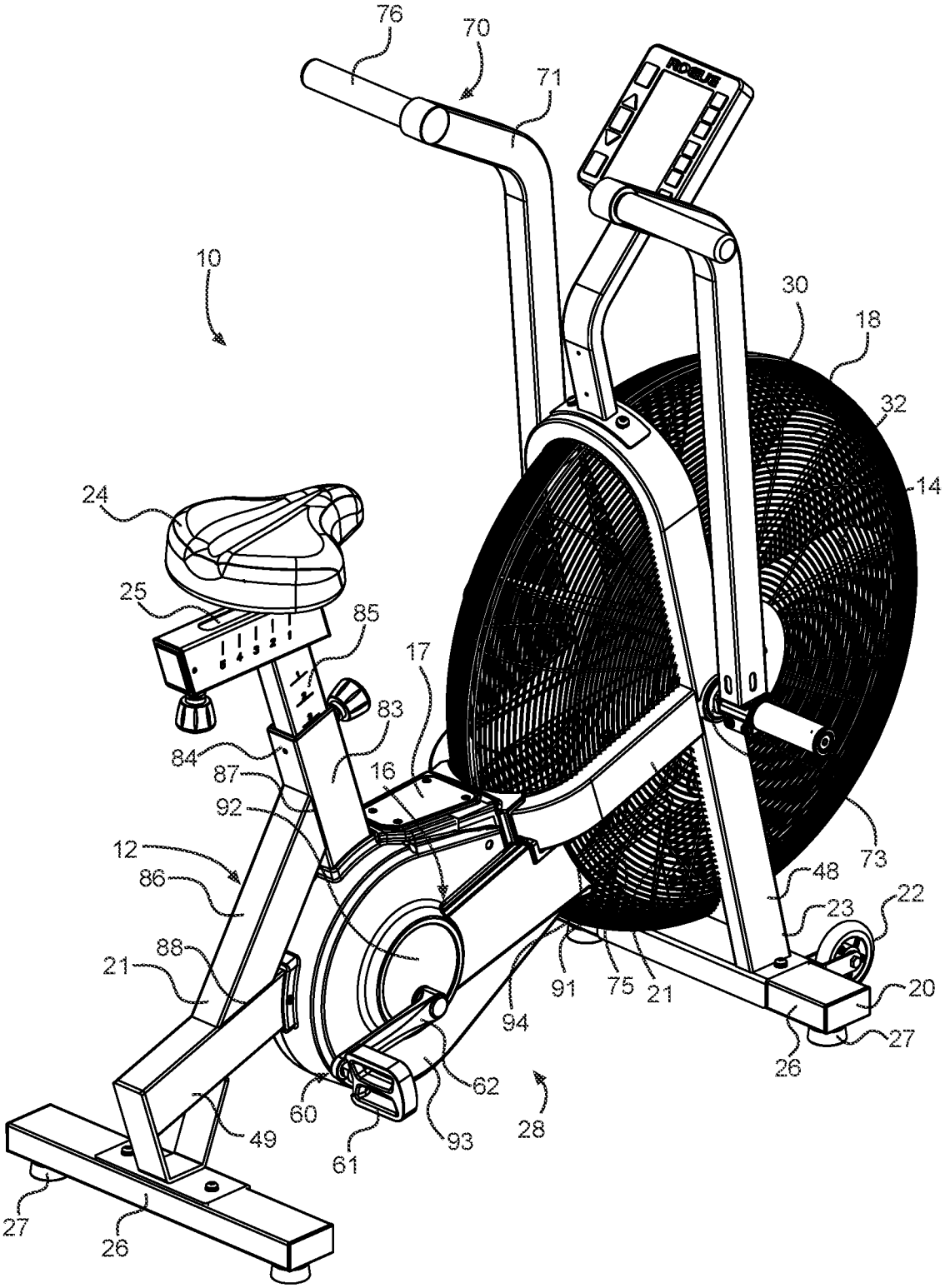
FIG. 2 is a top rear perspective view of the exercise bike of FIG. 1.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Referring now to the figures, and initially to FIGS. 1-12, there is shown an embodiment of an exercise bike or stationary bike 10 configured for stationary exercise. The bike 10 generally includes a frame or frame assembly 12, a rotor assembly 14 mounted on the frame 12, a drive assembly 16 mounted on the frame 12 and configured to drive rotation of the rotor assembly 14, and a cover 18 configured to at least partially cover the rotor assembly 14. The bike 10 may also include other components, such as a computer system that includes a computer interface 19 as shown in FIGS. 1-8.

Figure 5:
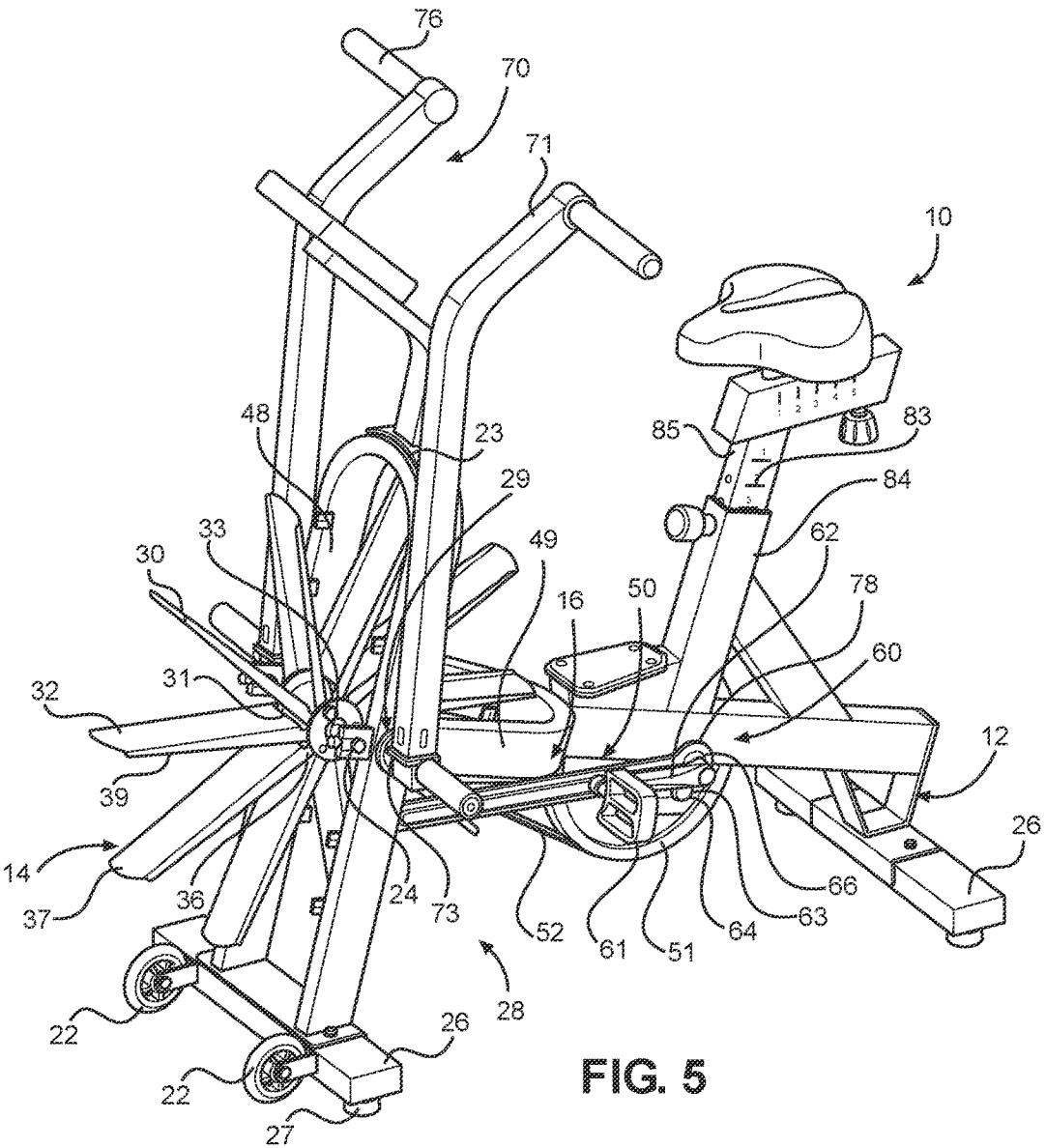
FIG. 5 is a top front perspective view of the exercise bike of FIG. 1, with some external components removed to show internal detail.
Figure 6:
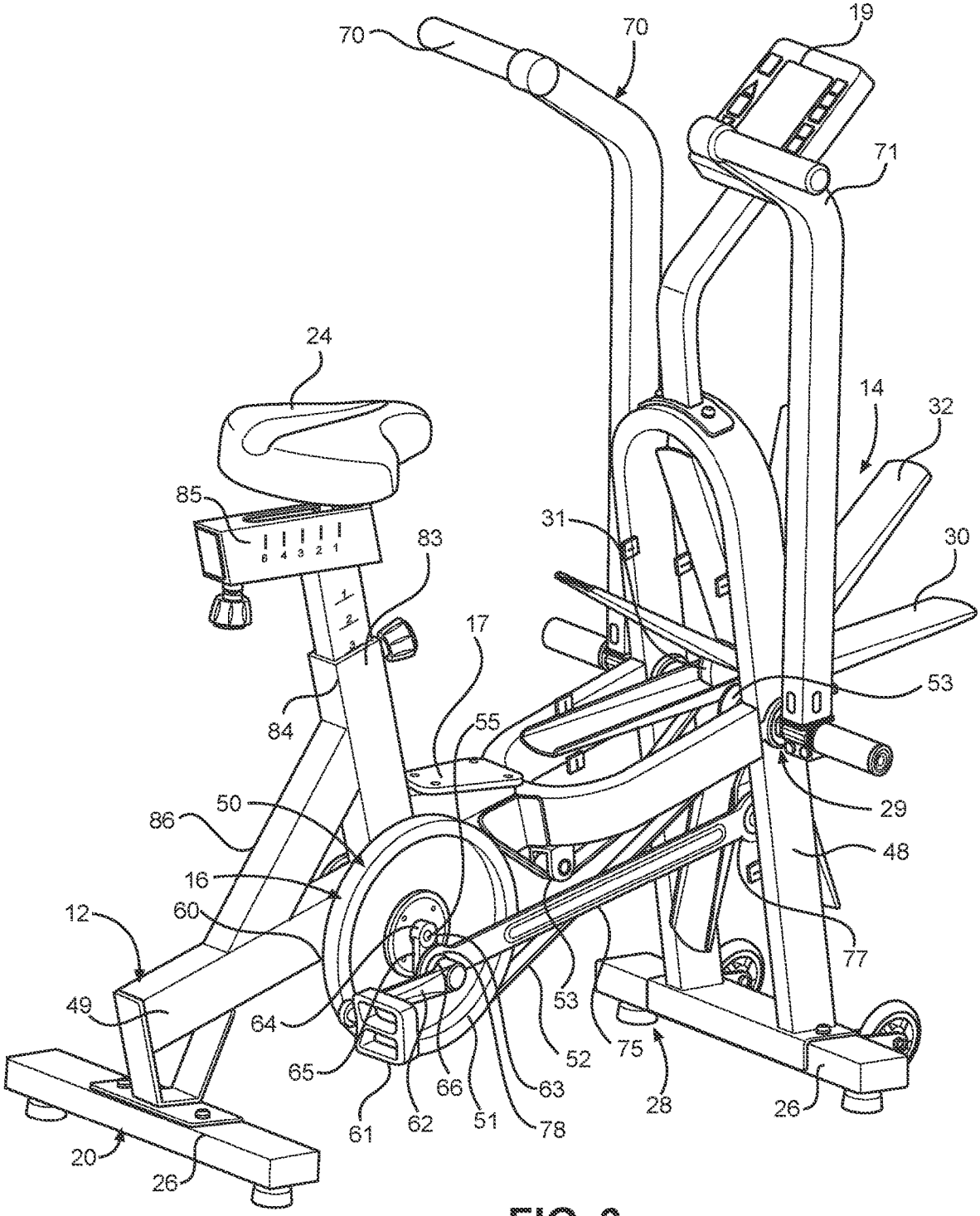
FIG. 6 is a top rear perspective view of the exercise bike of FIG. 1, with some external components removed to show internal detail.
Figure 7:
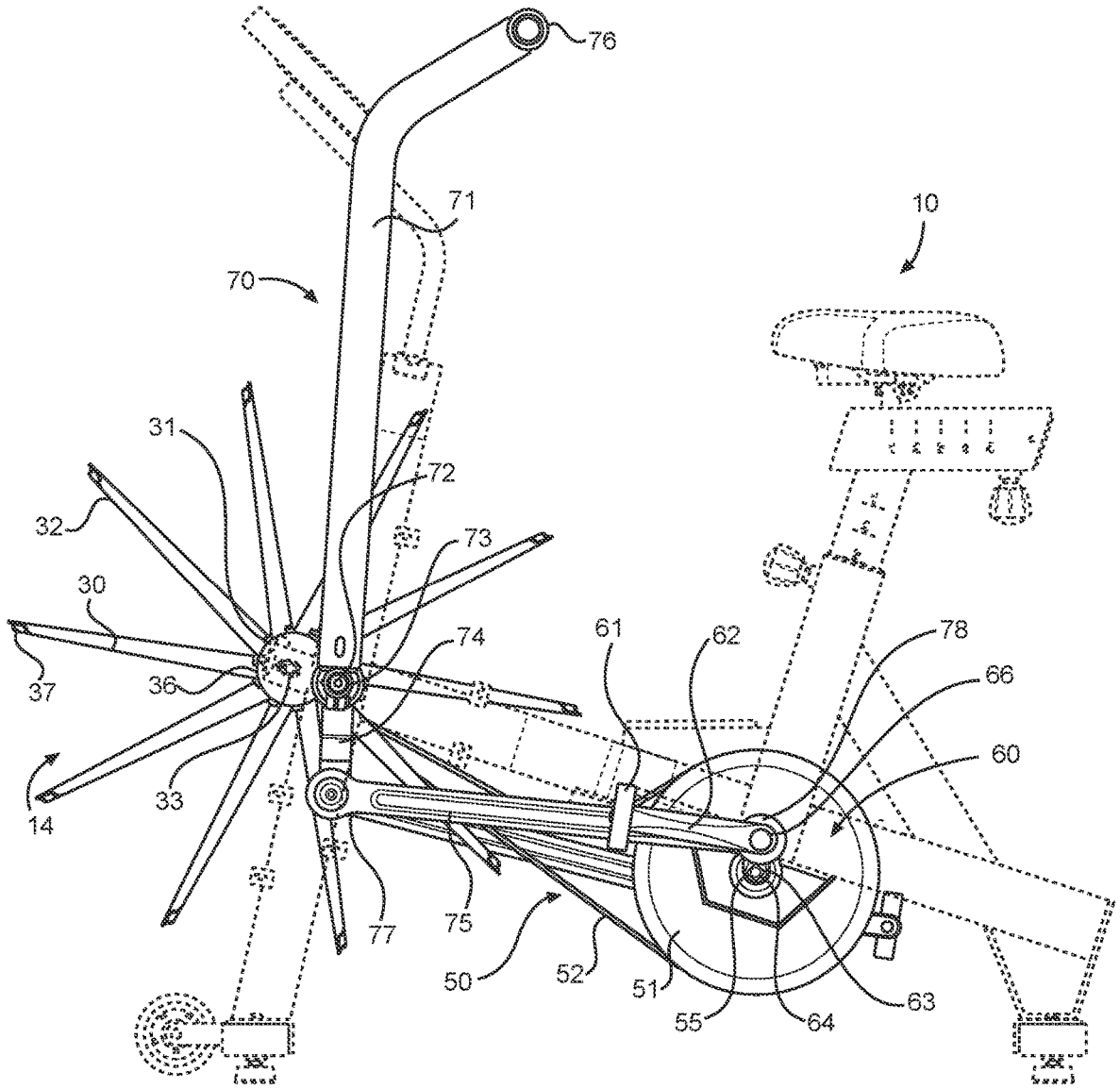
FIG. 7 is a right side view of the exercise bike of FIG. 1, with some external components removed and some additional components depicted in phantom to show internal detail.
Figure 8:
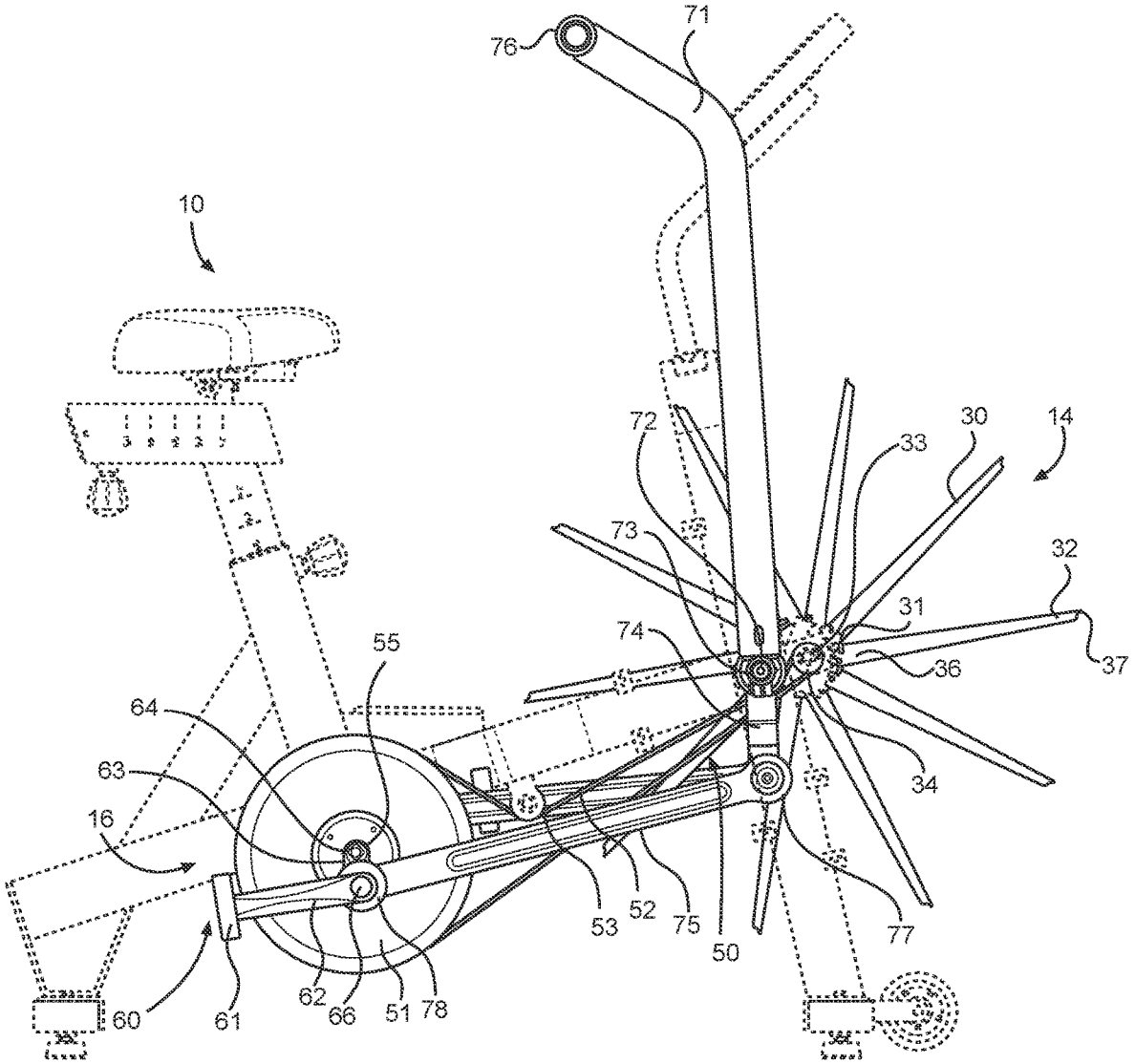
FIG. 8 is a left side view of the exercise bike of FIG. 1, with some external components removed and some additional components depicted in phantom to show internal detail.

The frame 12 includes a base 20 configured to rest on the ground or other supporting surface and a plurality of frame members 21 extending upward from the base 20 and supporting the other components of the bike 10. The base 20 in FIGS. 1-8 includes two base members 26, which are configured as cross-members extending laterally with respect to the frame 21, with each base member 26 including one or more ground engaging structures 27 directly connected thereto. The ground engaging structures 27 are configured as adjustable feet in FIGS. 1-8. In this configuration, the base members 26 and the ground engaging structures 27 support all other components of the bike 10, including the remainder of the frame 12. The ground engaging structures 27 of the base 20 may further include wheels 22 configured for movement of the bike 10 on the supporting surface. The frame members 21 include rotor support members 23 that support the rotor assembly 14 and components of the drive assembly 16 at the front of the bike 10. The rotor support members 23 in the embodiment of FIGS. 1-8 include axle mounts 24 that hold and/or support the axle 33 of the rotor assembly 14 as described herein. The frame 12 may further include a user support in the form of a seat 24 for the user to sit on during operation of the bike 10, as well as a seat support 83 supporting the seat 24, with adjustment mechanisms 25 for adjusting the vertical and/or horizontal position of the seat 24. A foot plate 17 is directly connected to the frame 12 in the embodiment of FIGS. 1-8, as shown in FIGS. 5-6, which creates a more stable and rigid structure than existing foot plates 17 that are directly connected to a housing supported by the frame 12. The frame 12 further has various connections and mounts for connection and mounting of other components of the bike 10, including components of the rotor assembly 14 and/or the drive assembly 16. For example, the frame 12 has one or more axle mounts (not shown) that hold and/or support the axle 55 of the input pulley 51. It is understood that the frame 12 may be differently configured in various other embodiments for desired appearance and/or ergonomics while retaining similar functionality. In other embodiments, the frame 12 and the components and features thereof (including the frame members 21) may be constructed with similar structural and functional elements having different configurations, including different ornamental appearances.

In one embodiment, as shown in FIGS. 1-8, the frame 12 includes features that provide a rigid and stable construction. For example, the frame 12 may include thick gauge or heavy duty frame members 21 in one embodiment, which may allow a stable and rigid construction to be achieved without additional structural reinforcement members. In the embodiment of FIGS. 1-8, the frame 12 defines a gap 28 at the bottom between the base members 26, such that no frame members 21 extend directly between the base members 26. In this configuration, the frame members 21 form an arch or span over the gap 28, with an apex 29 formed by ascending frame members 48, 49 that are connected to the base members 26. The ascending frame members 48, 49 include one or more front ascending frame members 48 that are connected to the front base member 26 and extend continuously upward and rearward from the front base member 26 to the apex 29, and one or more rear ascending frame members 49 that are connected to the rear base member 26 extend continuously upward and forward from the rear base member 26 to the apex 29. The ascending frame members 48, 49 in the embodiment of FIGS. 1-8 extend linearly to the apex 29 to form an angularly-shaped arch, but may have a curved and/or multi-angular configuration in another embodiment. In FIGS. 1-8, the frame 12 includes a pair of parallel, linear front ascending frame members 48 connected to the front base member 26 and extending upward/rearward on opposite sides of the rotor 30, and a single rear ascending frame member 49 connected to the rear base member 26 and extending upward/forward, splitting into two branches near the rotor 30 (forming a "tuning fork" or Y-shape) to connect to the front ascending frame members 48 at the apex 29. The ascending frame members 48, 49 in FIGS. 1-8 form a "spine" that supports the rest of the frame 12 and all other components of the bike 10. In this configuration, no portion of the frame 12 extends below the tops of the base members 26, other than the base members 26 themselves and any brackets or connecting structures that directly connect the remainder of the frame 21 (i.e., the ascending frame members 48, 49) to the base members 26. Thus, the lowest portions of the frame 21 are the base members 26 and any frame members 21 connected directly to the base members 26.

The seat support 83 in one embodiment includes a fixed portion 84 that is fixed with respect to the rest of the frame 12 and a moveable or adjustable portion 85 that is moveably connected to the fixed portion 84 to permit adjustment of the seat 24. In the embodiment of FIGS. 1-8, the moveable portion 85 and the seat 24 are vertically adjustable together using a vertical adjustment mechanism 25 on the fixed portion 84, and the moveable portion 85 further includes a horizontal adjustment mechanism 25 for horizontal adjustment of the seat 24 relative to the moveable portion 85. It is understood that the vertical adjustment mechanism 25 may result in some horizontal change in position as well, and that the horizontal adjustment mechanism 25 may likewise result in some vertical change in position. The fixed portion 84 in FIGS. 1-8 is a rectangular tube, and the moveable portion 85 includes a smaller rectangular tube or post that fits inside the fixed portion 84 and is axially moveable with respect to the fixed portion 84. The seat support 83 further has a reinforcing structure to reinforce and provide additional stability to the fixed portion 84, which includes a gusset or support member 86 that has a first end 87 connected to the rear side of the fixed portion 84 and a second end 88 to a lower point on the frame 12, e.g., the rear ascending frame member 49 in the embodiment of FIGS. 1-8. The gusset 86 intersects the fixed portion 84 at a transverse angle to provide both vertical and horizontal support. In the embodiment of FIGS. 1-8, the lower end of the gusset 86 is fixed to the central "spine" of the frame 12 (e.g., formed by the front and rear ascending frame members 48, 49) that supports all other components of the bike 10, rather than directly to the base 20 as in many existing designs.

Figure 3:
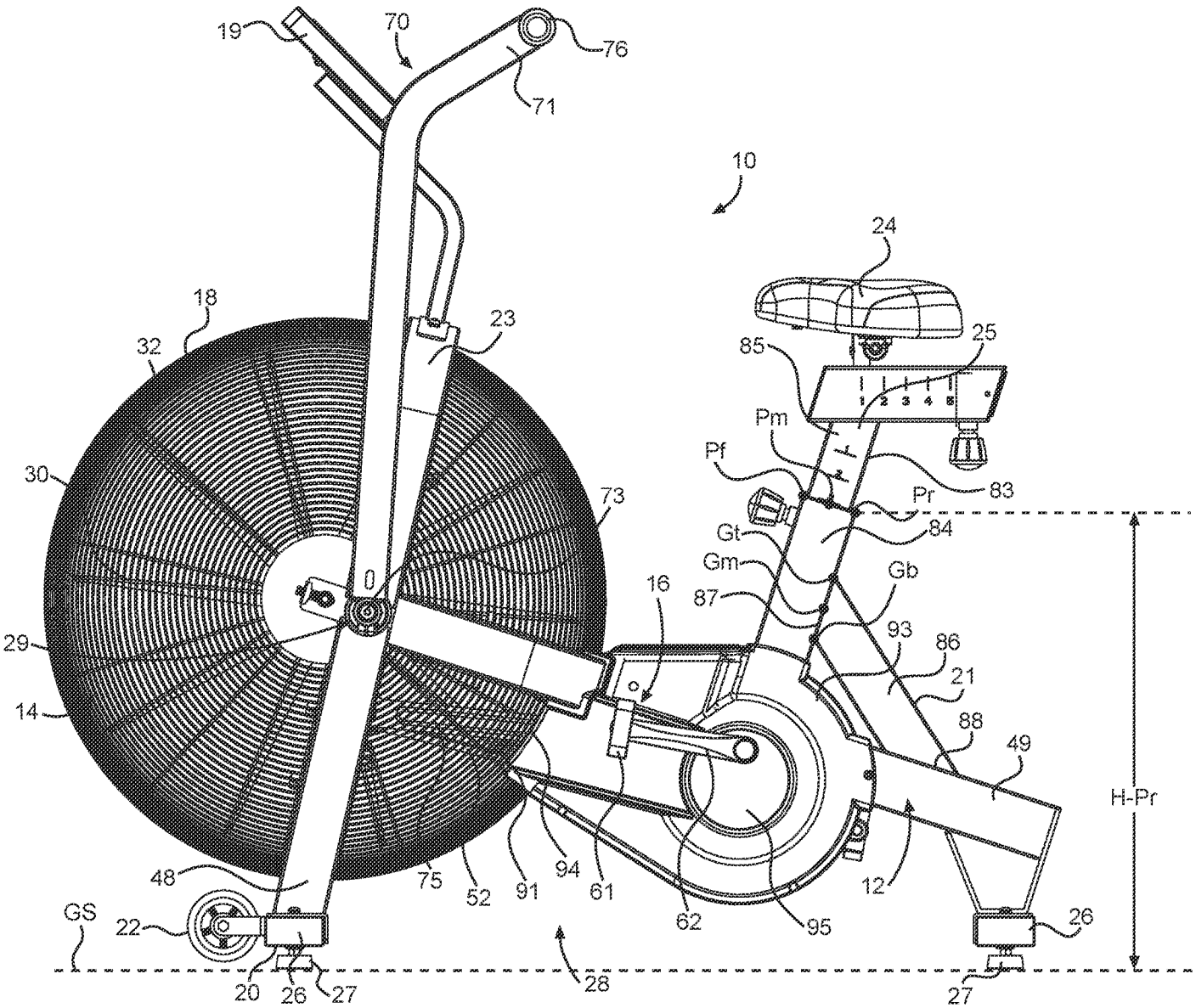
FIG. 3 is a right side view of the exercise bike of FIG. 1.
Figure 4:
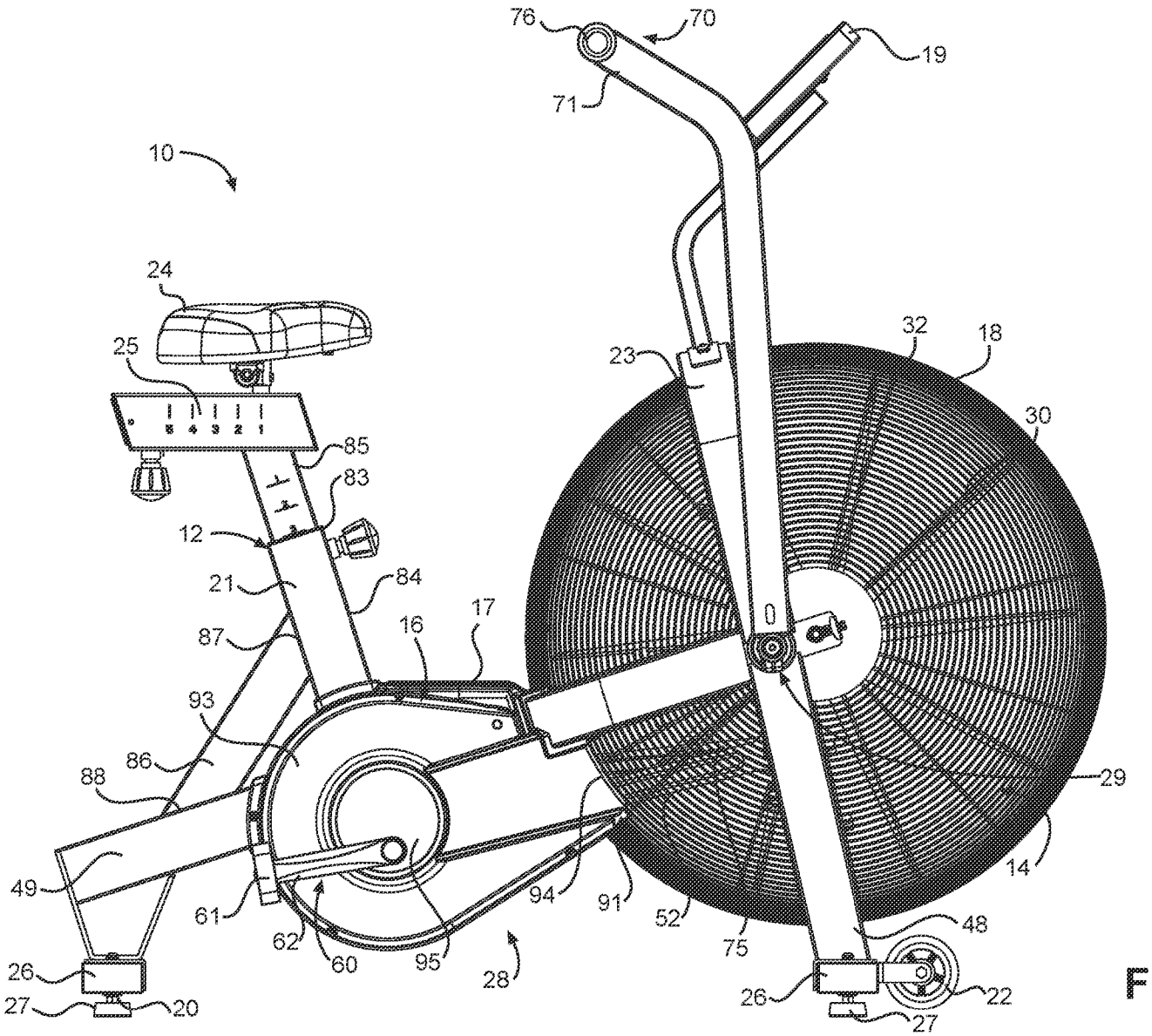
FIG. 4 is a left side view of the exercise bike of FIG. 1.

The gusset 86 intersects the fixed portion 84 of the seat support 83 at a high vertical position, in order to increase the overall stiffness of the fixed portion 84. In one embodiment, the uppermost point of the first end 87 of the gusset 86 (referred to as the top Gt of the gusset 86) is within 7 inches of the top of the fixed portion 84, measured along the rear surface of the fixed portion 84, or within 5 inches in another embodiment. In the embodiment of FIGS. 1-8, the top Gt of the gusset 86 is spaced 3.0-3.5 inches from the top of the fixed portion 84, measured along the rear surface of the fixed portion 84, e.g., about 3.2 inches (i.e., from the rear Pr of the fixed portion 84). The connection between the gusset 86 and the fixed portion 84 is also more proximate to the top of the fixed portion 84 than to the ground, which may be measured by various points on the gusset 86 and the fixed portion 84, as illustrated in FIG. 3. For example, if the midpoint Pm of the top of the fixed portion 84 and the midpoint Gm of the gusset 86 at the intersection between the gusset 86 and the fixed portion 84 are used as reference points, the height of the gusset midpoint Gm (measured from the ground surface GS) is 60-90% of the height of the midpoint Pm of the top of the fixed portion 84 in one embodiment, and 70-85% in another embodiment, e.g., about 78%. As another example, if the rear and/or lowest point Pr of the top of the fixed portion 84 and the top Gt of the gusset 86 at the intersection between the gusset 86 and the fixed portion 84 are used as reference points, the height of the gusset top Gt (measured from the ground surface GS) is 70-100% of the height of the rear and/or lowest point Pr of the top of the fixed portion 84 in one embodiment, and 75-90% in another embodiment, e.g., about 88%. In the embodiment of FIGS. 1-8, the top of the fixed portion 84 has heights of 25.4 in at the front and/or highest point Pf, 24.9 in at the rear and/or lowest point Pr, and 24.5 in at the midpoint Pm, and the gusset 86 has heights of 21.4 in at the top Gt, 17.5 in at the bottom Gb, and 19.5 in at the midpoint Gm. It is understood that while the top of the fixed portion 84 is angled in the embodiment of FIGS. 1-8, such that the front Pf, rear Pr, and midpoint Pm have different heights, the relative heights discussed above would apply to a fixed portion 84 that has a level height. By way of example, the height H-Pr of the rear and/or lowest point Pr of the top of the fixed portion 84 is illustrated in FIG. 3, with the understanding that the heights of the other structures referenced herein is defined in the same manner.

Figure 9:
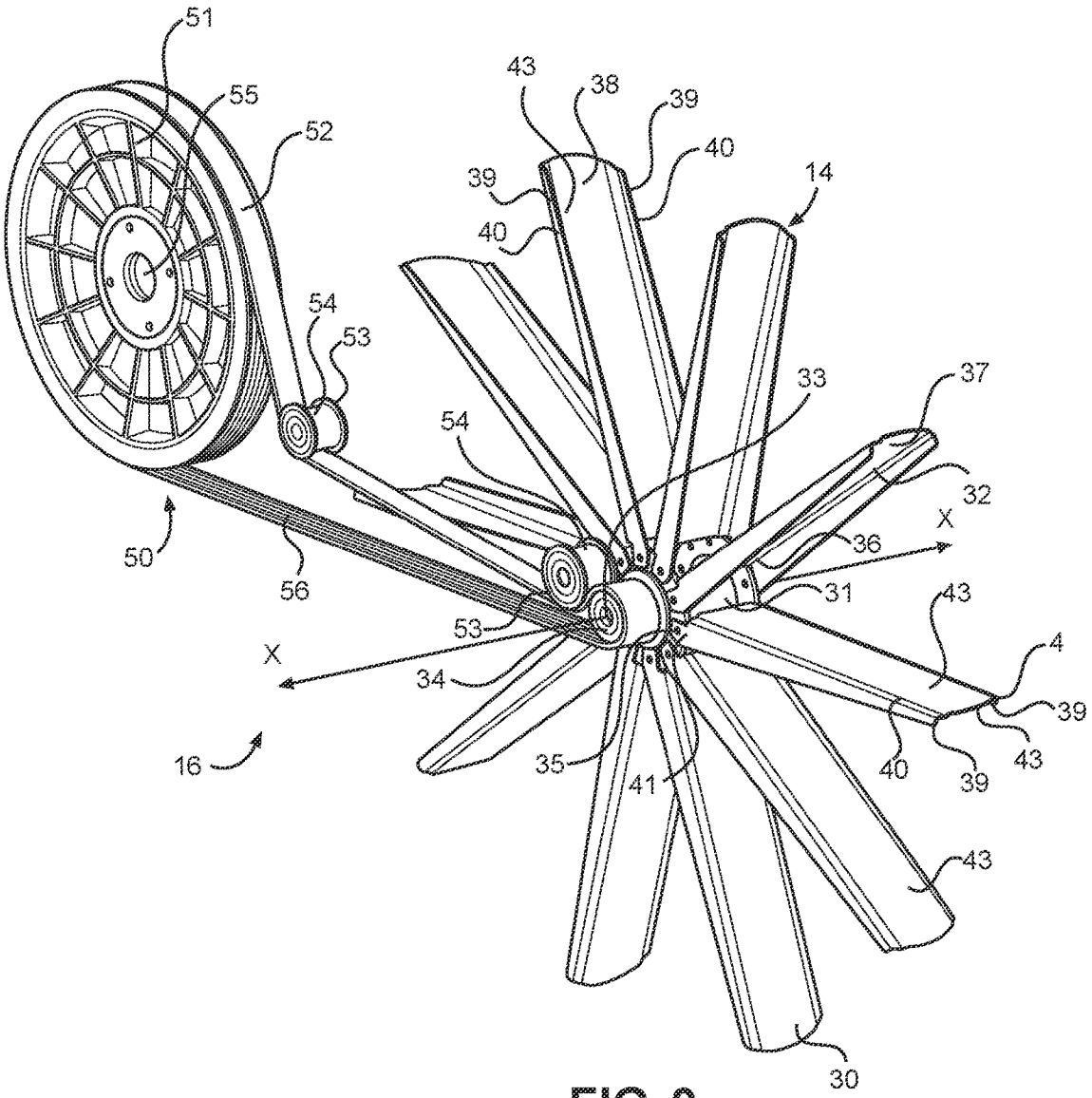
FIG. 9 is a top front perspective view of a portion of a pulley assembly and a rotor assembly of the exercise bike of FIG. 1.
Figure 10:
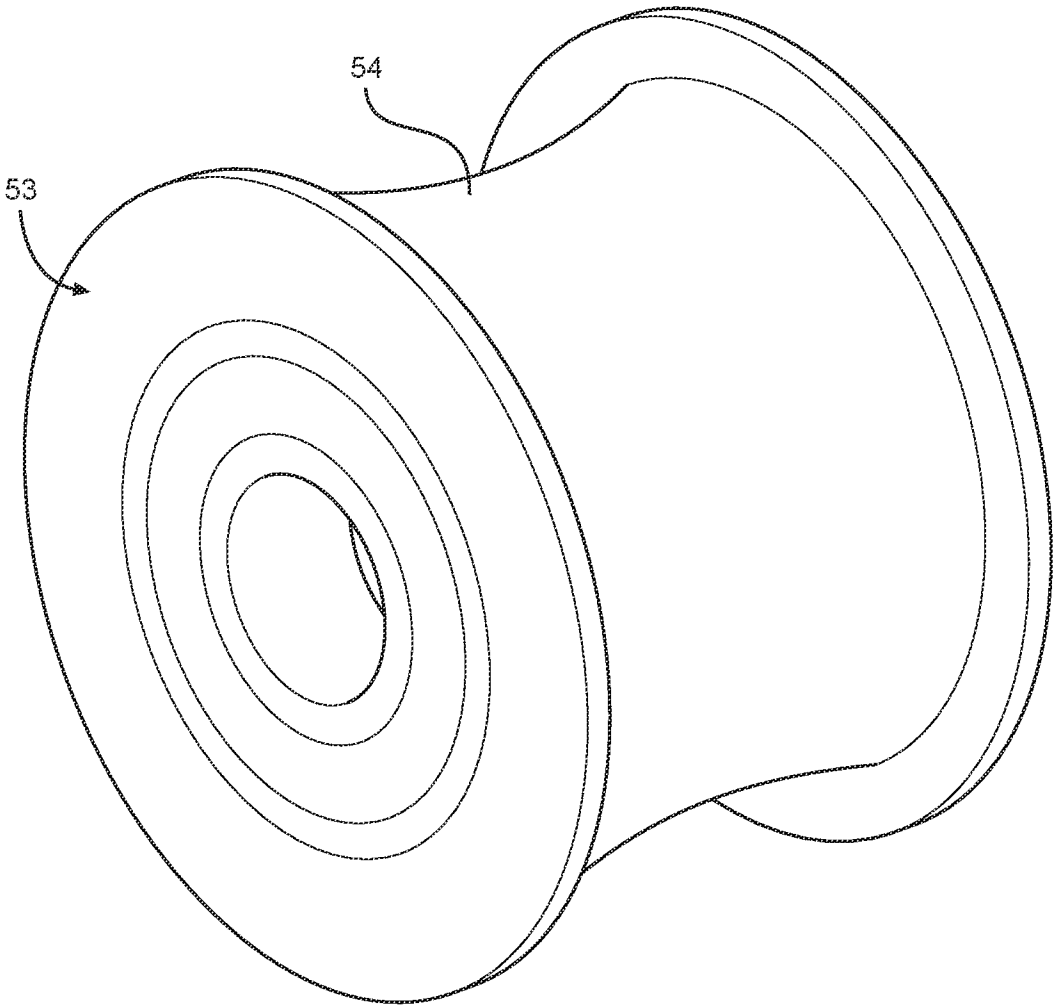
FIG. 10 is a top front perspective view of a roller of the pulley assembly of FIG. 9.
Figure 11:
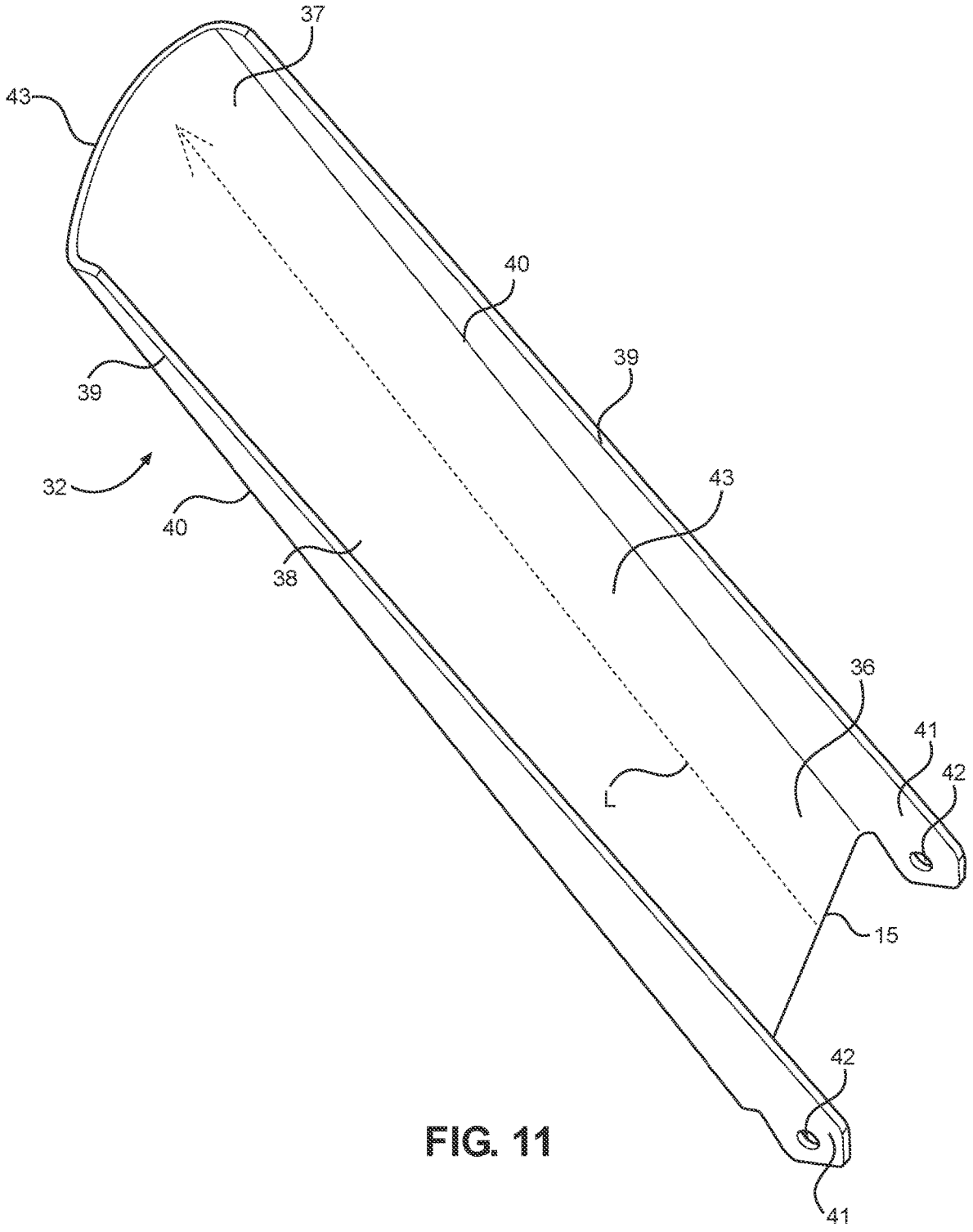
FIG. 11 is a perspective view of a blade of the rotor assembly of FIG. 9.
Figure 12:
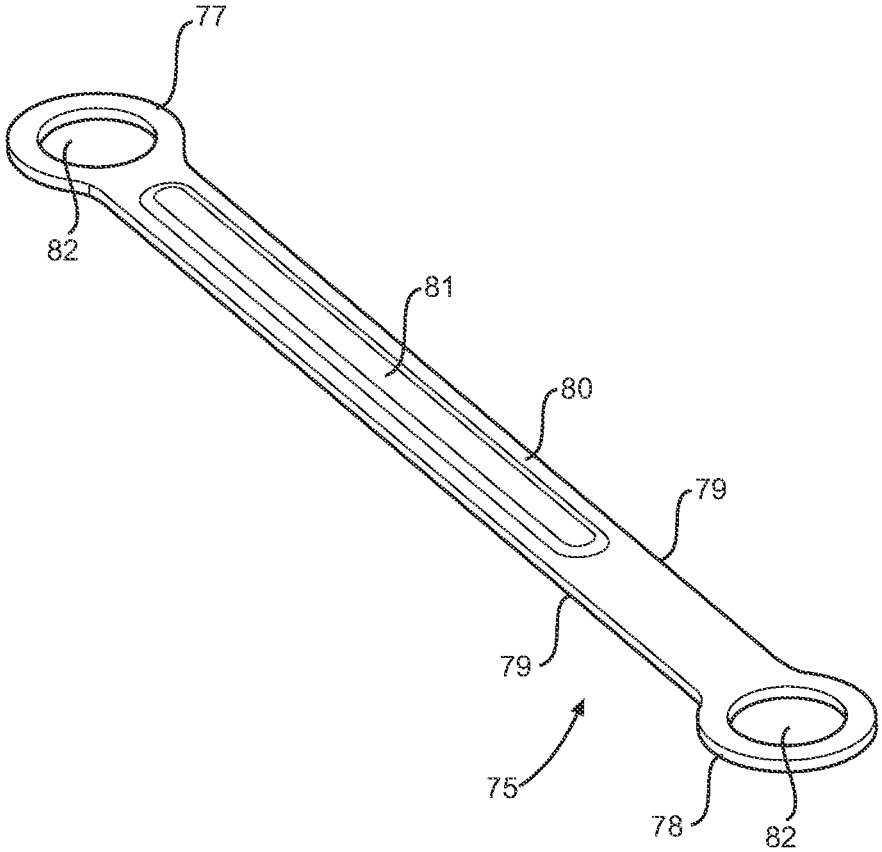
FIG. 12 is a perspective view of a linkage of the exercise bike of FIG. 1.

The rotor assembly 14 in the embodiment of FIGS. 1-8 is illustrated in greater detail in FIGS. 9-11 and includes a rotor 30 in the form of a fan having a hub 31 and a plurality of blades 32 connected to the hub 31 and extending outward from the hub 31 in radial directions. The blades 32 are connected to the hub 31 by connectors 35, which may be in the form of fasteners such as bolts, screws, rivets, etc., in the embodiment of FIGS. 1-11, but additional or alternate connecting structures may be used in other embodiments, such as tabs, slots, or other interlocking mechanical structures, or welding, brazing, soldering, adhesives, or other bonding structures. The hub 31 rotates on an axle or spindle 33, and the rotor assembly 14 further includes an output engagement member 34 that is engaged by the drive assembly 16 to drive rotation of the rotor 30. In the embodiment of FIGS. 1-11, the output engagement member 34 is a sprocket or pulley that is operably connected to the rotor 30 such that the pulley 34 is rotationally fixed with respect to the rotor 30. The pulley 34 is directly connected to the rotor 30 in one embodiment, and may be integrally connected to and/or part of a single piece with the hub 31. In other embodiments, the rotor 30 and the components thereof (including the blades 32) may be constructed with similar structural and functional elements having different configurations, including different ornamental appearances.

Figure 9A:
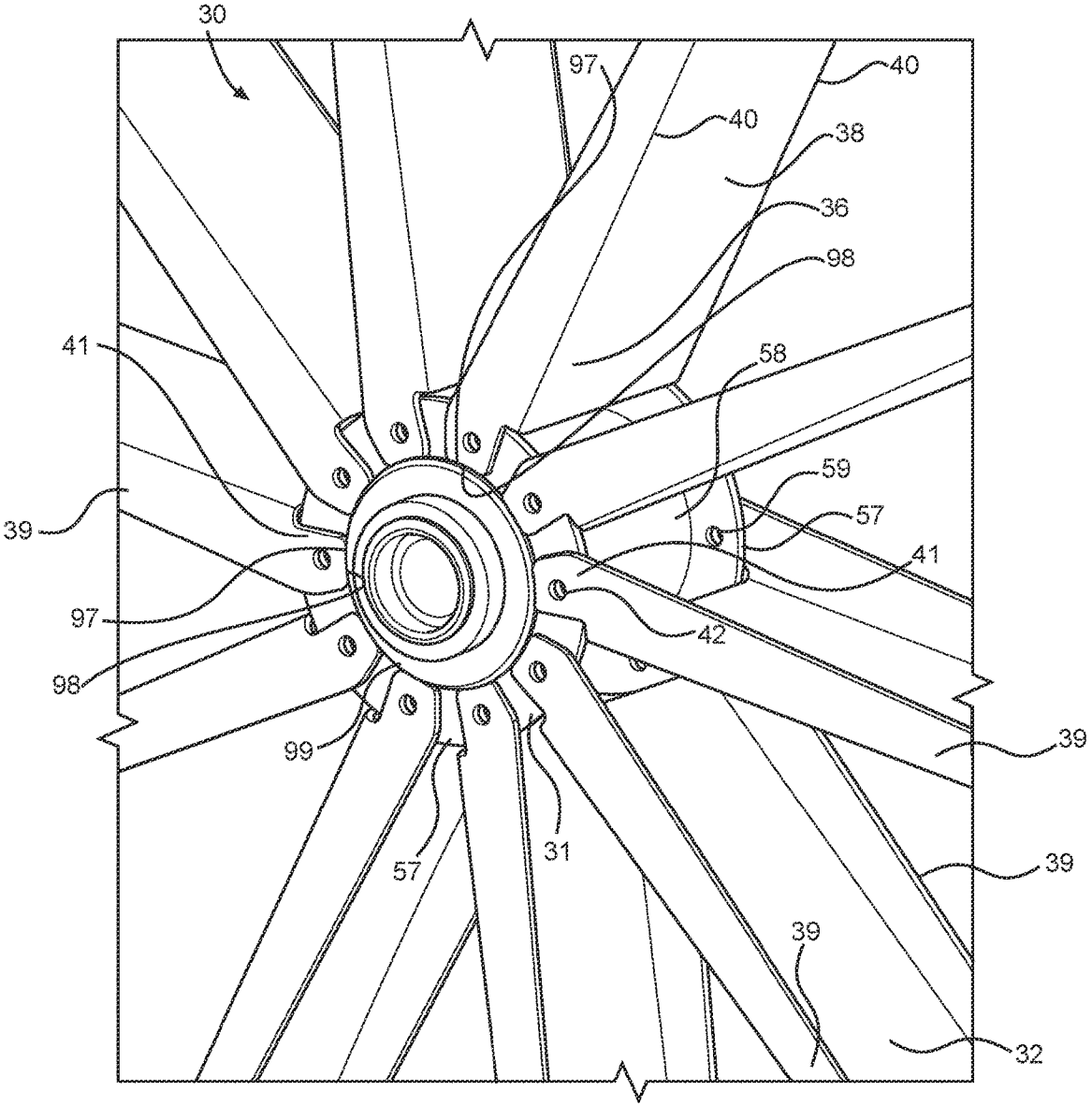
FIG. 9A is a top front perspective view of a portion of the rotor assembly of the exercise bike of FIG. 1.
Figure 9B:
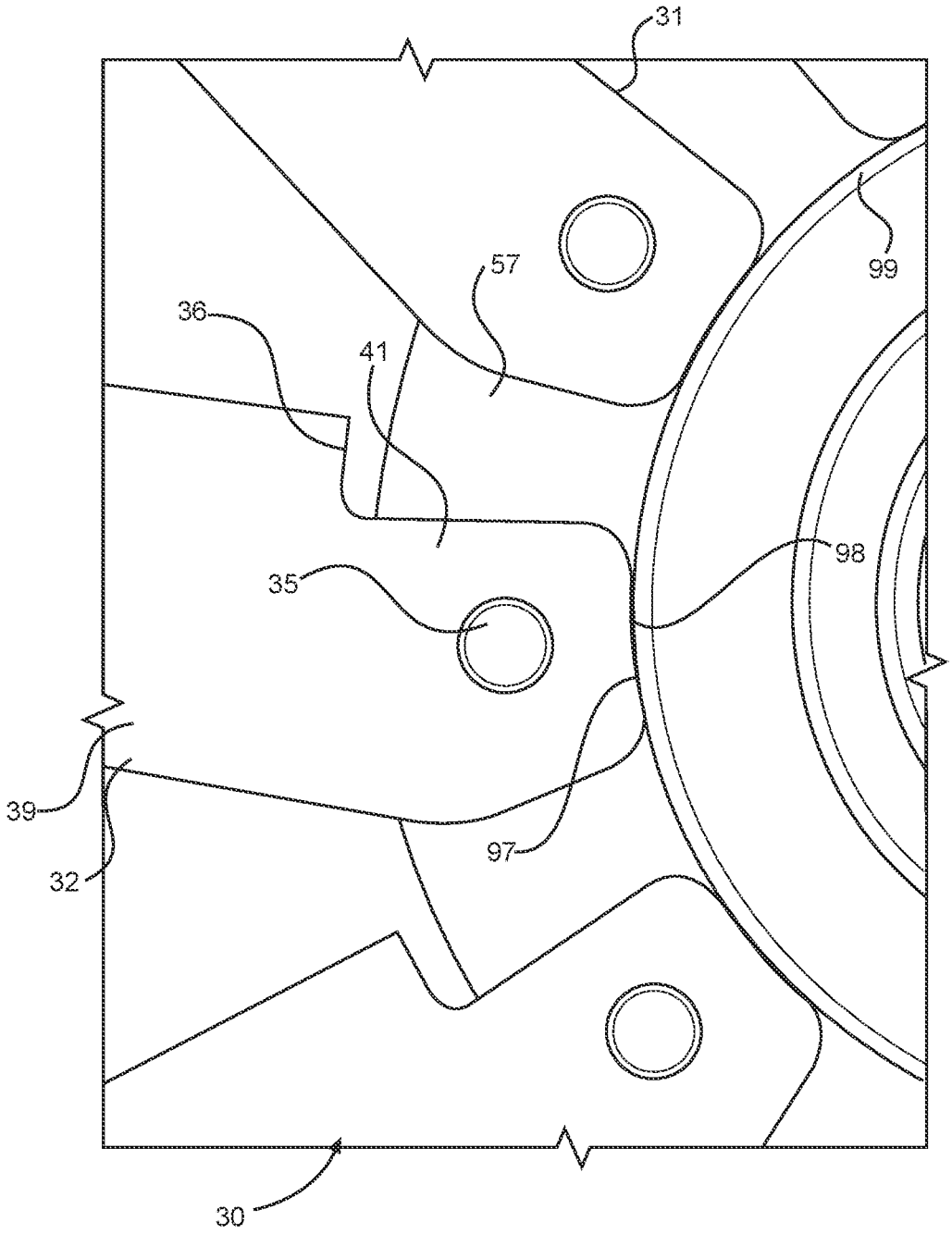
FIG. 9B is a magnified side view of a portion of the rotor assembly of the exercise bike of FIG. 1.
Figure 9C:
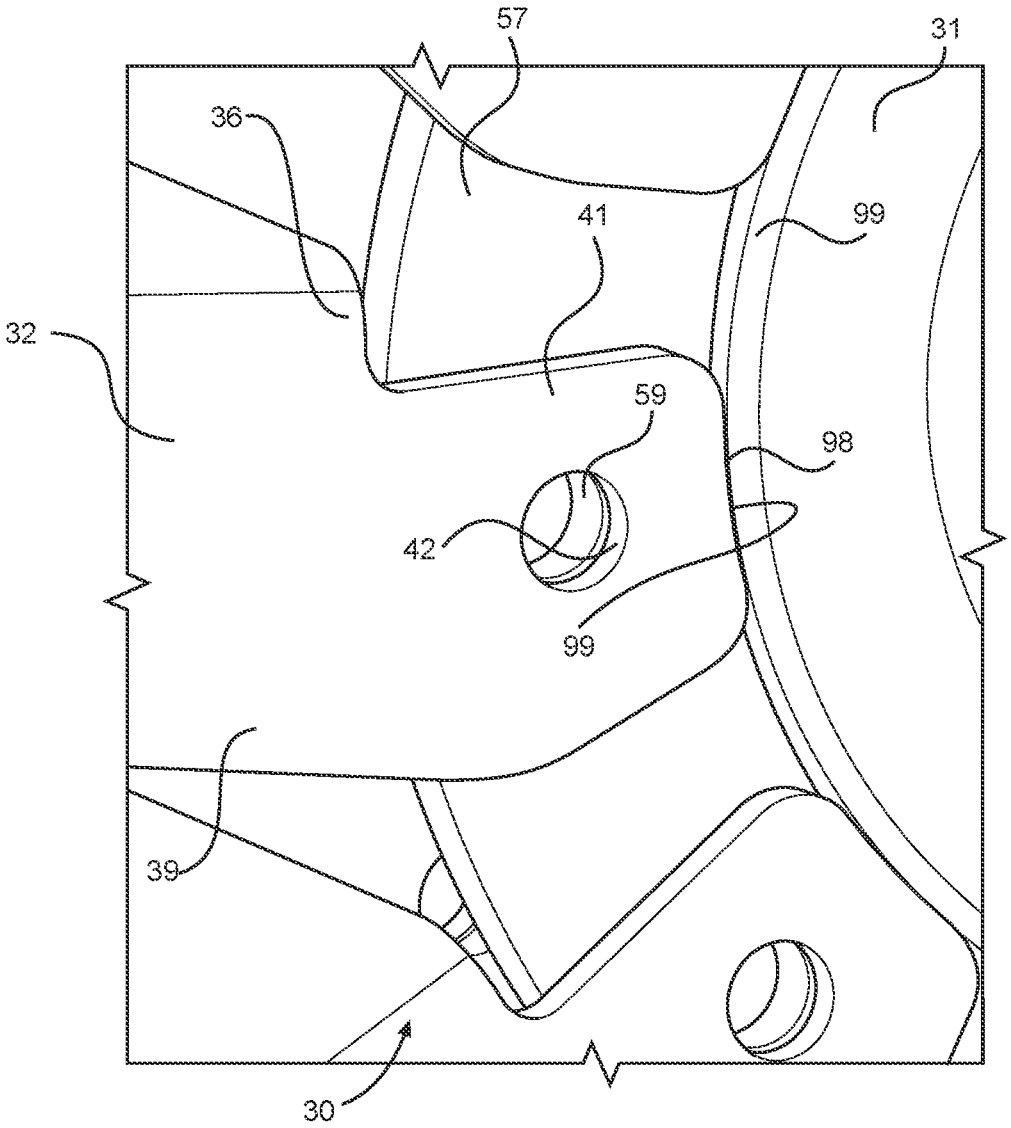
FIG. 9C is a magnified perspective view of a portion of the rotor assembly of the exercise bike of FIG. 1.

The blades 32 of the rotor 30 in FIGS. 1-11 are illustrated in greater detail in FIGS. 9-9C and 11. Each blade 32 has a proximal end 36 engaging the hub 31 and a distal end or free end 37 distal from the proximal end 36 and from the hub 31. Additionally, each blade 32 has an elongated body 38 having two wide, flat surfaces 43 and two opposed sides or edges 40 and extending between the ends 36, 37. The direction that each blade 32 extends from the hub 31, i.e., from the proximal end 36 toward the distal end 37, is defined as a longitudinal direction L (see FIG. 11 for reference) for each individual blade 32 as referenced herein, and it is understood that the blades 32 are each elongated along the longitudinal direction L in one embodiment. The blades 32 may also be considered to extend radially from the hub 31. The term "elongated" indicates that the body 38 has a larger dimension in the direction of elongation relative to the two directions perpendicular to the direction of elongation. Each blade 32 also has one or more flanges or baffles 39 that extend outward from the body 38 transverse to the surface of the body 38. In the embodiment of FIGS. 1-9C and 11, each blade 32 has two flanges 39 that extend along the opposed sides or edges 40 of the body 38. In other embodiments, one or more of the blades 32 may include a different number or arrangement of flanges 39, for example, by including one or more longitudinally extending flanges 39 located between the two edges 40 in addition to or instead of the flanges 39 extending along the edges 40. In the embodiment of FIGS. 1-9C and 11, the flanges 39 extend outwardly from only one flat surface 43 of the body 38 (e.g., the top surface), such that the blade 32 has a substantial U-shape or C-shape in cross-section. In another embodiment, the flanges 39 may extend outwardly from both flat surfaces 43 of the body 38, such that the blade 32 has a substantial I-shape in cross section. In another embodiment, the flanges 39 may extend outwardly from opposite flat surfaces 43 of the body 38, such that the blade 32 has a substantial S-shape in cross section. In a further embodiment, the flange(s) 39 may be located only on one of the sides 40 of the body 38. The flanges 39 in FIGS. 1-9C and 11 extend the entire length of the body 38, from the proximal end 36 to the distal end 37, but may extend less than the entire length of the body 38 in other embodiments. Additionally, the flanges 39 have a greater height near the proximal end 36 and taper continuously to a smaller height near the distal end 37 in the embodiment of FIGS. 1-9C and 11.

The blades 32 also have mounts 41 extending outward from the body 38 at the proximal end 36 to provide a mounting structure for connection to the hub 31. The mounts 41 extend from the proximal end 36 on both sides 40 of the body 38 in the embodiment of FIGS. 1-9C and 11, and each mount 41 has an opening 42 to receive the fasteners 35 for connection to the hub 31. The body 38 has a proximal edge 15 that extends between the mounts 41 in this embodiment. The fasteners 35 in this embodiment extend through the openings 42 in the mounts 41 and are connected to opposed side surfaces of the hub 31, such as by being received in openings (not shown), which may be threaded. As illustrated in FIGS. 9-9A, the hub 31 has two circular, plate-like end portions 57 with a cylindrical center body 58 having a smaller diameter than the end portions 57, such that the end portions 57 extend radially outward of the center body 58. The end portions 57 include openings 59 configured to receive the fasteners 35 for connection of the blades 32. The mounts 41 are contiguous with the flanges 39 in the embodiment of FIGS. 1-9C and 11 and may be considered to be extensions of the flanges 39, which adds strength and support to the mounts 41 for a more solid and stable connection. Additionally, because the flanges 39 extend transversely (e.g., vertically) from the body 38, the positioning of the mounts 41 at the ends of the flanges 39 allows the connection points with the hub (i.e., openings 42) to be offset from the general plane of the body 38. The openings 42 in FIGS. 1-9C and 11 are offset from the plane of the body 38 in the direction of forward rotation of the rotor 30. This offset orientation and arrangement permits the body 38 of each blade 38 to extend radially with respect to the hub 31, while providing clearance for connection of the fasteners 35.

In the embodiment of FIGS. 1-9C and 11, the blades 32 are all connected and supported only at the mounts 41 at the proximal ends 36, and no other structures engage the blades 32 between the proximal and distal ends 36, 37. In particular, the hub 31 and the connecting structures connecting the blades 32 thereto form the sole structure supporting the blades 32 and directly or indirectly connecting all of the blades 32 together. As described elsewhere herein, other connecting or mounting structures may be used to connect the blades 32 to the hub 31 in other embodiments, and the mounts 41 may be provided with such structures (e.g., integral hooks, tabs, or other connecting structures) and/or configured for connection with such structures. The blades 32 may each be made from a single integral piece, including the body 38, the flanges 39, and the mounts 41, such as by stamping.

In the embodiment of FIGS. 1-11, the rotor 30 has a stabilizing structure engaging the blades 32 to resist pivoting of the blades 32 with respect to the hub 31 due to the forces exerted on the blades 32 during rotation of the rotor 30 (e.g., air resistance). The stabilizing structure may include abutting and/or interlocking engagement surfaces 97, 98 on the hub 31 and the blades 32, respectively. FIGS. 9-9C illustrate one embodiment of a stabilization structure in the form of engagement surfaces 98 on the ends of the mounts 41 of each blade 32 and a cylindrical projection 99 forming complementary engagement surfaces 97 on the hub 31 that engage and abut the engagement surfaces 98 of each blade 32. The engagement surfaces 98 on the blades 32 in the embodiment of FIGS. 9-9C are spaced from the connection point(s) between the blades 32 and the hub 31 (e.g., the fasteners 35) and have a curved contour to match the curved outer contour of the cylindrical engagement surface 97 on the hub 31, creating a more stable engagement between the pieces. In the embodiment shown in FIGS. 9-9C, the hub 31 has cylindrical projections 99 forming engagement surfaces 97 on both sides of the hub 31, and each blade 32 has engagement surfaces 98 on both mounts 41. In another embodiment, the engagement surfaces 97, 98 may be positioned on only one side of the hub 31 and/or on only one mount 41. The engagement of the engagement surfaces 97, 98 in this embodiment resists pivoting of the blades 32 about the connection point with the hub 31 (i.e., the fastener 35). It is understood that the engagement surfaces 97, 98 of the hub 31 and the blades 32 may be defined in the same locations and configurations by a different structure in other embodiments. For example, the engagement surfaces 97 of the hub 31 may be defined by intermittent projections around the hub 31 instead of a single cylindrical projection 99. As another example, the engagement surfaces 98 of each blade 32 may be defined on extensions of the flanges 39 even if the mounting structure for connection with the hub (e.g., mounts 41) is located and/or structured differently. In further embodiments, the stabilizing structure may be in the form of one or more additional connectors 35 connecting each blade 32 with the hub 31 that are offset from the connectors 35 in FIGS. 9-9C, or a different type of interlocking and/or abutting engagement structure. Such alternate engagement structure may include engagement with the body 38 of the blade 32 (e.g., edge 15) and/or engagement with the end portions 57 or the center body 58 of the hub 31. Further, the stabilizing structure in FIGS. 1-11 stabilizes the blades 32 against pivoting in either rotational direction relative to the connectors 35, and in another embodiment, the rotor 30 may have a stabilizing structure that only stabilizes the blades 32 against pivoting rearward during forward rotation of the rotor 30.

The blades 32 in this embodiment have increased weight and rigidity as compared to blades 32 of existing fans or other rotors for exercise bikes, and the flanges 39 provide the blades 32 with increased rigidity and bending stiffness as well as a secure and rigid structure for mounting the blades 32 to the hub 31 as described above. These heavier and sturdier blades 32 have increased inertia, resulting in more smooth and consistent effort throughout the pedal stroke and less vibration, and ultimately better overall feel for the user.

In the embodiment of FIGS. 1-11, the pulley 34 and the rotor 30 (including the hub 31, the blades 32, and any fasteners 35 or other connecting structure) form a unitary rotational body. This unitary rotational body has increased mass and increased moment of inertia (MOI) with respect to the rotational axis, as compared to existing fans or other rotors for exercise bikes in one embodiment, due in part to the construction of the blades 32 described herein. In one embodiment, the unitary rotational body has a weight of at least 3.5 lb or at least 9 lb, e.g., 3.5-13 lb or 5-11 lb. The blades 32 in one embodiment may be made from steel and may each weigh at least 0.6 lb, or 0.6-1.0 lb, or about 0.8 lb in one configuration. The total weight of the rotor 30 in this embodiment is at least 9 lb, or 9-12 lb, or about 10-11 lb in one configuration, and the unitary rotational body has a MOI with respect to the rotational axis (indicated by X-X in FIG. 9) of at least 450 lb*in$^2$, or 450-550 lb*in$^2$, or about 495 lb*in$^2$. In another embodiment, the blades 32 may be made from aluminum (which term includes aluminum alloys) and may each weigh at least 0.4 lb, or 0.4-0.5 lb, or about 0.45 lb in one configuration. The total weight of the rotor 30 in this embodiment is at least 3.5 lb, or 3.5-8 lb, or about 6 lb in one configuration, and the unitary rotational body has a MOI with respect to the rotational axis of at least 150 lb*in$^2$, or 150-200 lb*in$^2$, or about 170 lb*in$^2$. The blades 32 may be formed of other materials in other embodiments, including other metals and alloys, polymers, or composite materials, e.g., carbon fiber composites.

Figure 27:
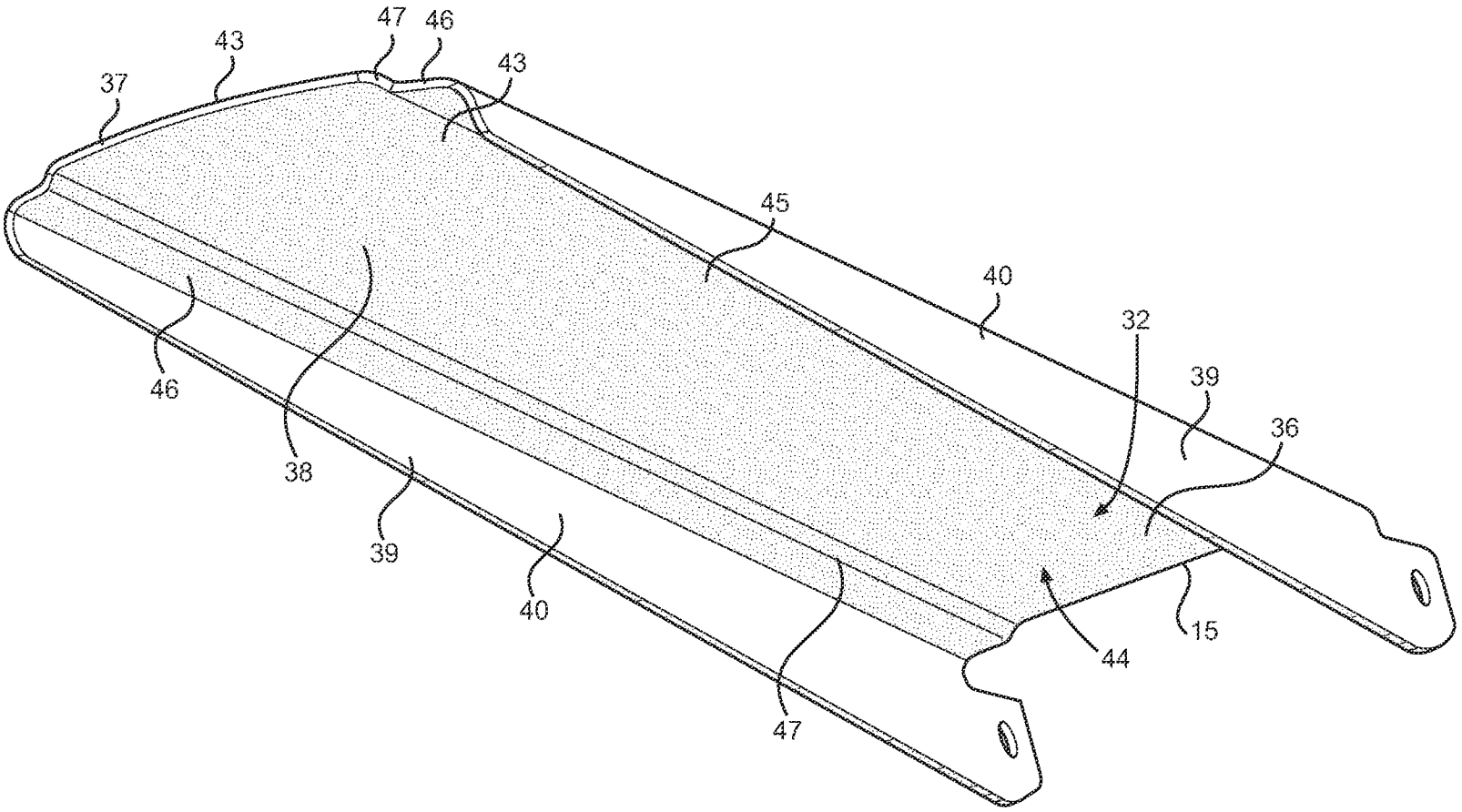
FIG. 27 is a perspective view of the blade of FIG. 21, with shading to indicate a leading surface of the blade.

The rotor 30 in FIGS. 1-9C has ten blades 32, and in one embodiment, the rotor 30 has no more than twelve blades 32, e.g., 8 to 12 blades 32. The diameter of this rotor may be 27 inches in one embodiment. Rotors of existing exercise bikes typically include a much larger number of blades, and such existing rotors do not achieve a moment of inertia as described herein with as few as 8 to 12 blades 32. Additionally, the blades 32 as described herein provide a large surface area, a correspondingly large aerodynamic profile and air displacement, and a large reflected MOI (the MOI perceived by the user after incorporation of mechanical advantage through the drive assembly 16) with a small number of blades 32, e.g., 8 to 12 blades as described herein. For example, the surface area of the unitary rotational body as described herein may be at least 1000 in$^2$, or 1000-1200 in$^2$, or about 1100 in$^2$. The surface area of the leading surface 44 of each blade 32, i.e., the surfaces facing into the direction of forward rotation that encounter direct air resistance during rotation, is at least 20 in$^2$ or 20-40 in$^2$ in one embodiment, or 25-35 in$^2$ in another embodiment. The leading surface 44 in the embodiments of FIGS. 1-24 and 27 is formed of the forward facing edges of the flanges 39 and the surface 43 between the flanges 39. An example of the leading surface 44 is indicated by shading in FIG. 27. The surface area of the leading surface 44 of each fan blade 32 in FIGS. 1-11 is about 34 in$^2$, and the surface area of the leading surface 44 of each fan blade 32 in FIGS. 13-24 and 27 is about 28 in$^2$. In one embodiment, the surface 43 of each blade 32 on the leading surface 44 faces directly into the direction of rotation of the rotor 30, i.e., is perpendicular to the tangential direction of travel during rotation. This configuration increases drag and air resistance and provides a uniform feel during use. As another example, the reflected MOI of the unitary rotational body including a mechanical advantage (gear ratio) of 7.540 is at least 9 lb*in$^2$, or 9-12 lb*in$^2$, or about 10.25 lb*in$^2$.

The weight/mass of the rotor 30 is more evenly distributed over the diameter of the rotor 30 as compared to many existing rotors, which are perimeter-weighted. For example, in one embodiment, approximately 30-50% of the weight of the rotor 30 and/or the unitary rotational body is located within 25% of the maximum diameter of the rotor 30, and in another embodiment, this ratio is 35-45%, e.g., about 40%. As another example, in one embodiment, approximately 50-70% of the weight of the rotor 30 and/or the unitary rotational body is located within 50% of the maximum diameter of the rotor 30, and in another embodiment, this ratio is 55-65%, e.g., about 60%. As a further example, in one embodiment, approximately 70-90% of the weight of the rotor 30 and/or the unitary rotational body is located within 75% of the maximum diameter of the rotor 30, and in another embodiment, this ratio is 75-85%, e.g., about 80%. In the embodiment of FIGS. 13-24, the unitary rotational body has a total weight of 10.6 lb and a diameter of 27 in, and the weight located within 25% of the maximum diameter is about 4.1 lb, the weight located within 50% of the maximum diameter is 6.5 lb, and the weight located within 75% of the maximum diameter is 8.7 lb.

Figure 20:
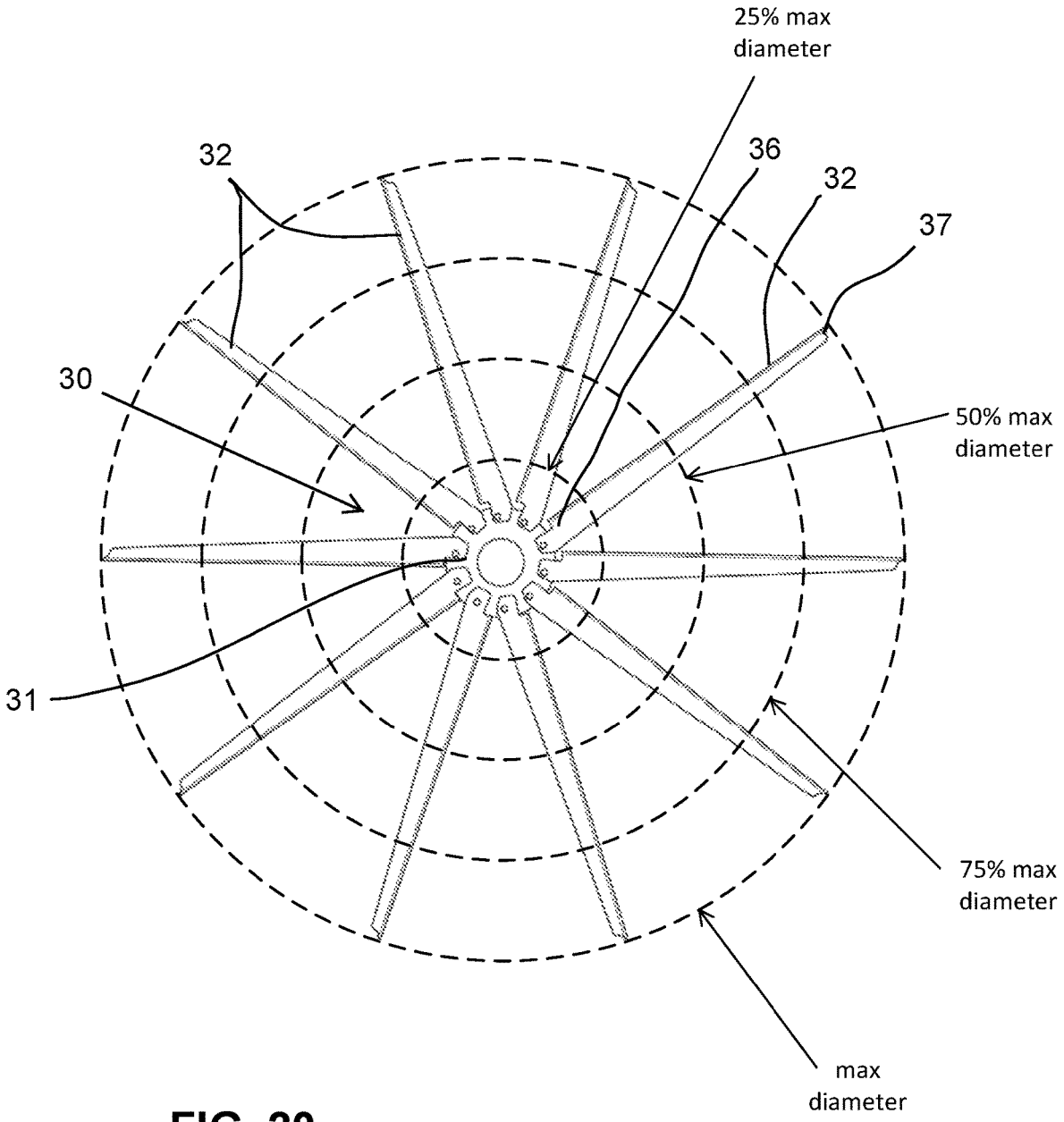
FIG. 20 is a schematic view illustrating the rotor of FIG. 18 with boundaries illustrating 25%, 50%, 75%, and 100% of the maximum diameter of the rotor 30.

It is understood that components or properties (e.g., mass/weight or MOI) being within a specified "XX %" of the maximum diameter of the rotor 30 or unitary rotational body as shown in FIG. 20 and described herein refers to being within a linear distance of XX % of the diameter of the rotor 30, measured from the rotational axis of the rotor 30 in use to the outermost periphery of the rotor 30, and measured perpendicular to the rotational axis. In other words, this phrase is meant to signify that the components or properties are located within a cylinder having a central axis aligned with the rotational axis of the rotor 30 in use and a cylindrical diameter of XX % of the diameter of the rotor 30, measured from the rotational axis of the rotor 30 in use to the outermost periphery of the rotor 30, and measured perpendicular to the rotational axis. Additionally, as used herein, the portion (ratio or %) of the total MOI of the rotor 30 or unitary rotational body that is formed by the structures within a specific XX % of the maximum diameter of the rotor 30 (as shown in FIG. 20) is referred to as a "partial MOI."

The MOI of the rotor 30 is affected by the mass distribution described above, and the resultant MOI is also more evenly distributed over the diameter of the rotor 30 as compared to existing rotors, and perimeter-weighted rotors in particular. In the embodiments of FIGS. 1-11 and FIGS. 13-24 described herein, the unitary rotational body has a diameter of 27 in and a total MOI of 435-531 lb*in$^2$ or about 483.0 lb*in$^2$, and the portion of the MOI located within 25% of the maximum diameter is 10-13 lb*in$^2$ or about 11.6 lb*in$^2$, the portion of the MOI located within 50% of the maximum diameter is 67-81 lb*in$^2$ or about 73.9 lb*in$^2$, and the portion of the MOI located within 75% of the maximum diameter is 201-245 lb*in$^2$ or about 223.2 lb*in$^2$. In one such embodiment, the partial MOI of the rotor 30 or the unitary rotational body located within 25% of the maximum diameter is 2-3%, the partial MOI located within 50% of the maximum diameter is 13-19%, and the partial MOI located within 75% of the maximum diameter is 38-56%. In another embodiment, at least a 40% portion of the total MOI of the rotor 30 or the unitary rotational body is located within 75% of the maximum diameter.

Figure 24:
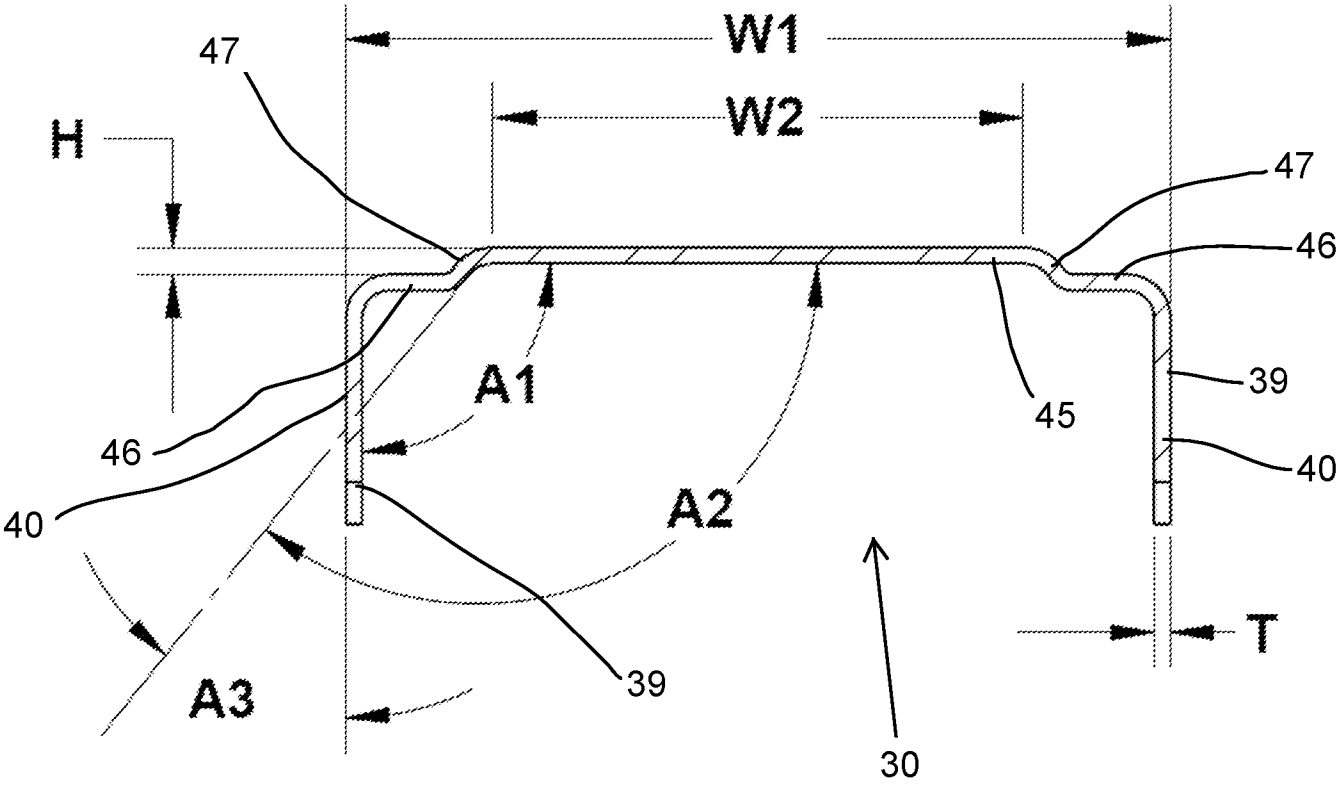
FIG. 24 is a cross-sectional view taken along lines 24-24 of FIG. 22.

In one embodiment, the cross-sectional area and incremental weight of each blade 32 decreases in the longitudinal direction L, along at least a portion of the length of the blade 32. As used herein, "cross-sectional area" refers to the area of the blade 32 perpendicular to the longitudinal direction L, e.g., as shown in FIG. 24. Additionally, as used herein, "incremental weight" refers to the weight of each of a number (e.g., 10, 100, 1000, etc.) of sequential, equal-length incremental segments of the blade 32 along the longitudinal direction L. In embodiments where the rotor 30 includes a plurality of such blades 32, the incremental radial weight of the rotor 30 also decreases over at least a portion of the diameter of the rotor 30, from the exterior of the hub 31 to the outer diameter (i.e., the distal ends 37 of the blades 32). As used herein, "incremental radial weight" refers to the weight of each of a number (e.g., 10, 100, 1000, etc.) of sequential, incremental annular or tubular segments of the rotor 30 along the radial direction centered on the axis of rotation of the rotor 30 and having equal radial widths. For example, in one embodiment, the cross-sectional area and incremental weight of a blade 32 decreases in the longitudinal direction L, along at least 25%, at least 50%, or at least 75% of the length of the blade 32. Likewise, the incremental radial weight of the rotor 30 in such embodiments may also decrease over at least 25%, at least 50%, or at least 75% of the diameter of the rotor 30. In the embodiment of FIGS. 1-11, the cross-sectional area and incremental weight of each blade 32 decreases continuously in the longitudinal direction L, along the entire length of the blade 32, from the proximal edge 15 or the proximal end 36 to the distal end 37. In embodiments where the rotor 30 includes a plurality of such blades 32, the incremental radial weight of the rotor 30 also decreases continuously over the entire diameter of the rotor 30, from the exterior of the hub 31 to the outer diameter (i.e., the distal ends 37 of the blades 32).

The drive assembly 16 is operably connected to the rotor assembly 14 and configured to drive rotation of the rotor assembly 14 through mechanical effort exerted by a user. The drive assembly 16 in FIGS. 1-12 includes a pulley assembly or belt and pulley assembly 50 that drives rotation of the rotor assembly 14, a pedal assembly 60 configured to drive the pulley assembly 50 by rotational motion, and an arm assembly 70 configured to drive the pulley assembly 50 by reciprocal motion.

The pulley assembly 50 includes at least an input pulley 51 operably coupled to and configured to receive power input from the pedal assembly 60 and/or the arm assembly 70, an output pulley in the form of the sprocket or pulley 34 configured to transfer power to the rotor 30, and a belt 52 engaging the input pulley 51 and the output pulley 34 to transfer power from the input pulley 51 to the output pulley 34. The input pulley 51 rotates on an axle or spindle 55, and the output pulley 34 rotates on the axle 33 of the rotor 30. The pulley assembly 50 may also include and one or more tension pulleys 53 located between the input pulley 51 and the output pulley 34. The input pulley 51 and the output pulley 34 engage the inner surface of the belt 52, and in the embodiment of FIGS. 1-10, the inner surface of the belt 52 has multiple grooves 56 running along the length of the belt 52 to assist in guiding the belt 52. The belt 52 may have another configuration in other embodiments, including being configured as a chain or other flexible loop structure. The pulley assembly 50 in FIGS. 1-10 includes two tension pulleys 53 located near the input pulley 51 and the output pulley 34, respectively. The tension pulleys 53 engage the outer surface of the belt 52 to increase the tension in the belt 52 and to increase the surface area engagement between the belt 52 and the input and output pulleys 51, 34, in order to reduce slippage. The tension pulleys 53 may be considered to divert the path of the belt 52 and create a more circuitous path for the belt 52 so that the belt 52 does not extend directly between the input and output pulleys 51, 34. In this embodiment, exertion by the user on the pedal system 60 and/or the arm system 70 causes rotation of the input pulley 51, which drives rotation of the output pulley 34, thereby driving rotation of the rotor 30. It is understood that the relative diameters of the input pulley 51 and the output pulley 34 may be designed to create a desired mechanical advantage, and that the diameter of the input pulley 51 may be larger than the diameter of the output pulley 34 for that reason. The input pulley 51, the output pulley 34 and the tension pulley(s) 53 in the embodiment of FIGS. 1-10 are made from metal for increased durability, but may be made from other materials in other embodiments.

The tension pulleys 53 in the embodiment of FIGS. 1-10 each have a concave annular surface 54 that engages the belt 52. This concave surface 54 was demonstrated through testing to assist in guiding the belt 52 and reduce lateral movement or disconnection of the belt 52. The effectiveness of this concave surface 54 for increasing stability and decreasing lateral movement of the belt 52 is surprising, because general knowledge in the art of pulleys dictates that the annular surface 54 should be convex, rather than concave. Generally, belts are known to travel toward the highest point of tension, and a convex surface creates the highest point of tension in the center of the pulley, which should translate into improved performance in resisting lateral travel. A pulley with a concave surface 54 should provide inferior performance based on the general knowledge in the art. Nevertheless, the concave pulley surface 54 was demonstrated to perform in a superior manner for the tension pulleys 53, such that the belt 52 remained centered on the input pulley 51 and the output pulley 34 a greater amount of time during use. The concave surface 54 may have a radius of curvature of 1.0-1.5 inch in one embodiment, and the concave surface 54 in FIGS. 1-10 has a radius of curvature of about 1.25 inch.

Figure 25:
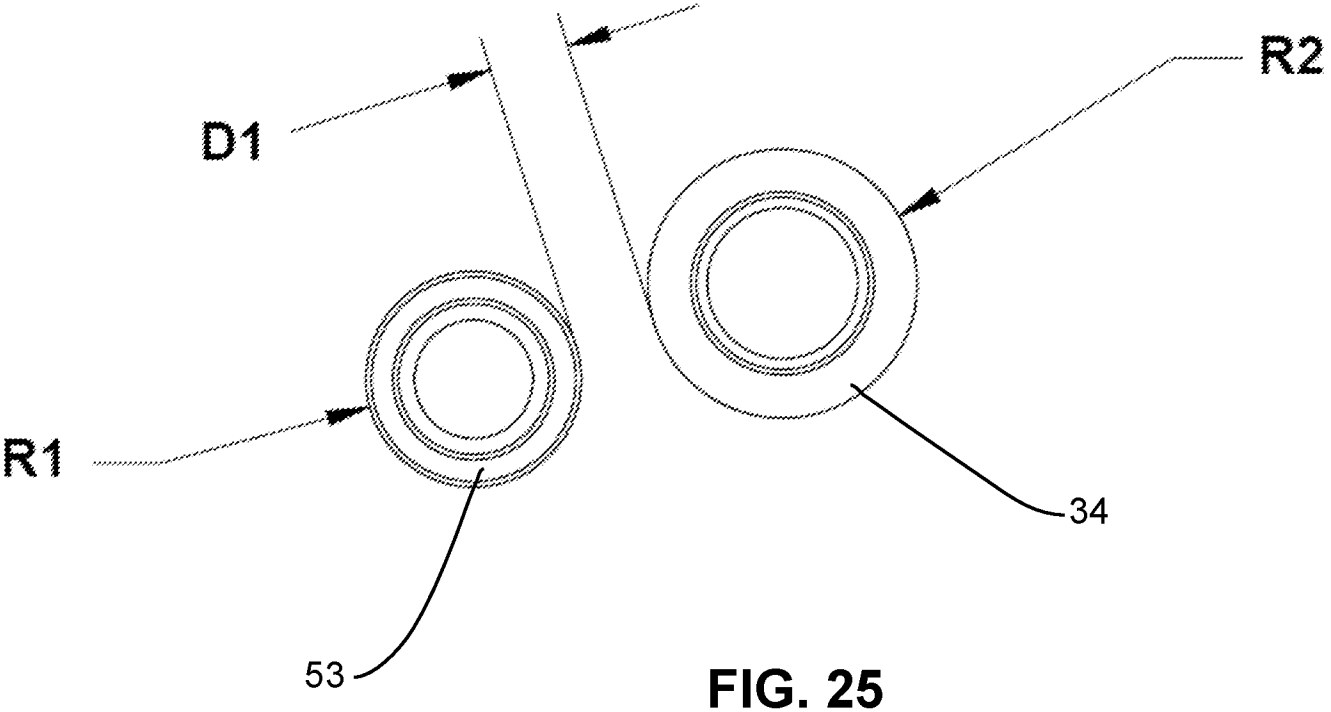
FIG. 25 is a schematic side view showing an output pulley and a tension pulley of the exercise bike of FIG. 17.
Figure 26:
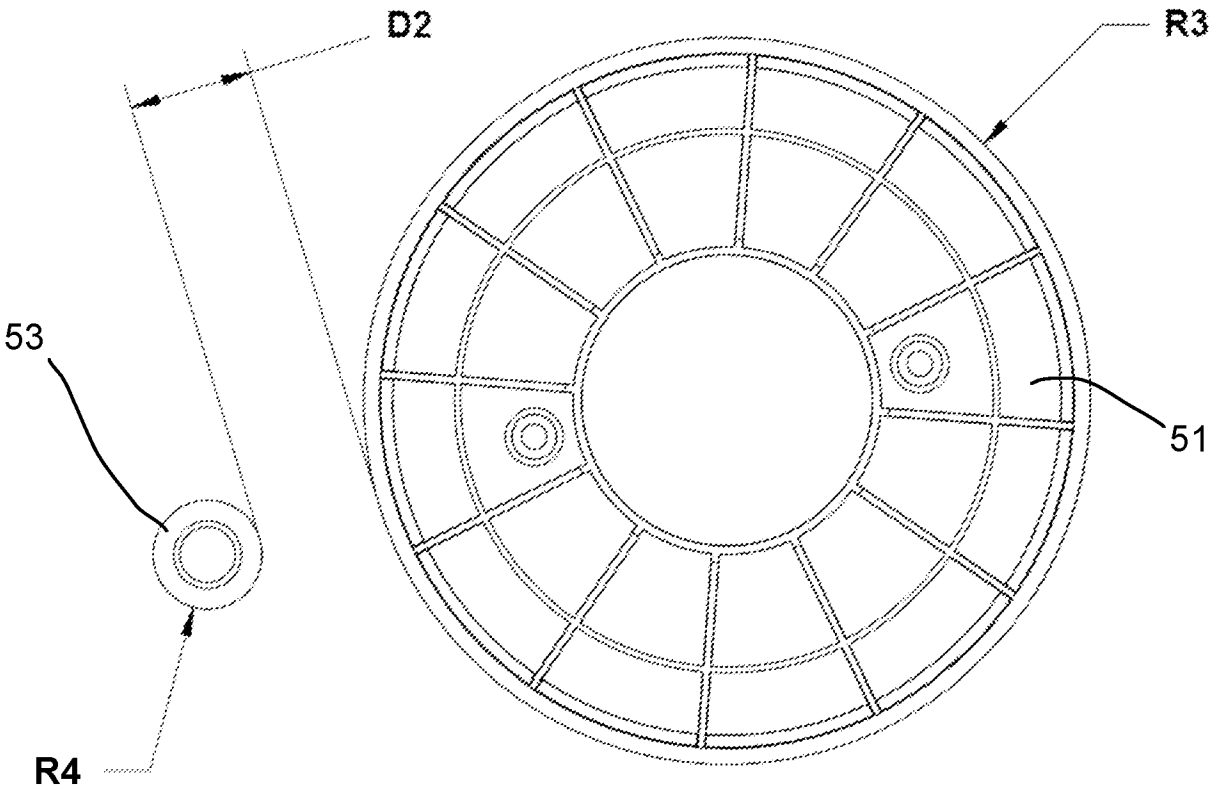
FIG. 26 is a schematic side view showing an input pulley and a tension pulley of the exercise bike of FIG. 17.

The input pulley 51, the output pulley 34, and the tension pulleys 53 in various embodiments may be arranged to increase contact between the belt 52 and the pulleys 51, 34. FIGS. 25 and 26 illustrate one embodiment of the input pulley 51, the output pulley 34, and the tension pulleys 53 that can be used in connection with embodiments described herein. The tension pulley 53 proximate the output pulley 34 has a radius R1 of 15-25 mm or about 20 mm in one embodiment, and the output pulley 34 has a radius R2 of 20-30 mm or about 25 mm in one embodiment. The tension pulley 53 and the output pulley 34 are positioned such that the shortest distance D1 between the pulleys in this embodiment is 10-20 mm, or about 15 mm, and the pulleys 34, 53 are positioned such that the belt 52 is engaged with 50-65% of the circumference of the output pulley 34, or about 57% in one embodiment. The tension pulley 53 proximate the input pulley 51 has a radius R4 of 17-28 mm or about 17.5 mm in one embodiment, and the input pulley 51 has a radius R3 of 130-170 mm or about 150 mm in one embodiment. The tension pulley 53 and the input pulley 51 are positioned such that the shortest distance D2 between the pulleys in this embodiment is 45-55 mm, or about 51 mm, and the pulleys 51, 53 are positioned such that the belt 52 is engaged with 60-75% of the circumference of the output pulley 34, or about 69% in one embodiment. The pulleys 51, 34, 53 of FIGS. 25-26 can be used in connection with any embodiments described herein.

The pedal assembly 60 as shown in FIGS. 1-10 generally includes two pedals 61 each attached to the end of one of two cranks 62 via spindle mechanisms, with each of the cranks 62 operably connected to the input pulley 51 on opposite sides of the input pulley 51 to drive rotation of the input pulley 51. In the embodiment of FIGS. 1-10, the cranks 62 are connected to the input pulley 51 by bell cranks 63 to create an eccentric revolving mechanism. Each bell crank 63 has a pivot connection 64 that is rotationally fixed to the input pulley 51 and allows the bell crank 63 to rotate on or in alignment with the axle 55 of the input pulley 51, as well as an arm 65 with an orbital connection 66 at or near the distal end thereof. The orbital connection 66 orbits the pivot connection 64 and is connected to the pedal 61, such as by the spindle mechanism discussed herein. Cyclical motion of the pedals 61 by user exertion thus drives rotation of the input pulley 51. The pedal assembly 60 may include additional components, such as spindles, axles, and connecting structures to connect the components of the pedal assembly 60 to each other and/or to other components such as the frame 12 or the pulley assembly 50. For example, in one embodiment, the pivot connection 64 may be connected to drive rotation of the axle 55 to thereby drive rotation of the input pulley 51, and in another embodiment, the pivot connection 64 may be directly connected to the input pulley 51 such that both the bell crank 63 and the input pulley 51 rotate freely on the axle 55. It is understood that other pedal mechanisms may be used to drive rotation of the input pulley 51 in other embodiments, such as a spindle mechanism where the cranks 62 drive rotation of the input pulley 51 by rotation of the spindle.

The arm assembly 70 as shown in FIGS. 1-12 generally includes two arms 71 each connected to an axle 72 at a pivot point 73, with each of the axles 72 connected to a lever arm 74 and each of the lever arms 74 connected to a linkage or connecting rod 75 that is operably connected to the pulley assembly 50 and the pedal assembly 60. One of the linkages 75 is shown in greater detail in FIG. 12. Each of the arms 71 is an elongated member with a grip 76 that may extend transversely to the arm 71. The arms 71 are connected to the axles 72 and are configured to pivot forward and backward about the pivot point 73 in an oscillating motion, and the user can use the grips 76 to push and pull the arms 71 in this oscillating motion. The grips 76 as shown in FIGS. 1-8 extend perpendicular to the arms 71, but may be configured at oblique (i.e., non-perpendicular) angles to the arms 71 in other embodiments. For example, the grips 76 may extend outwardly and rearwardly (i.e., toward the seat 24) at oblique angles to the arms 71 in one embodiment, which may improve ergonomics. Further, the grips 76 shown in FIGS. 1-8 are fixed with respect to the arms 71, but may additionally or alternately be connected to the arms 71 in a manner so as to be freely rotatable about their axes of elongation.

In the embodiment of FIGS. 1-12, the proximal ends of the lever arms 74 are rotationally fixed with respect to the ends of the arms 71, such as by the arms 71 and the lever arms 74 both being rotationally fixed with respect to the respective axles 72. In this configuration, the lever arms 74 move with the same pivoting and oscillating motion as the arms 71. The distal ends of the lever arms 74 are connected to a first end 77 of each of the linkages 75 at a connecting structure 82 such that the linkage 75 can freely rotate with respect to the distal ends of the lever arms 74. Oscillating movement of the arms 71 and the lever arms 74 results in forward and backward reciprocating motion of the linkages 75. A second end 78 of each of the linkages 75 is connected to the orbital connection 66 at the distal end of the bell crank 63 by a connecting structure 82 and is also freely rotatable with respect to the orbital connection 66. In this configuration, the reciprocating movement of the linkages 75 drives the orbital movement of the bell crank 63 and thereby also drives rotation of the input pulley 51 through mechanisms described herein. Accordingly, the user can exert force to drive rotation of the main pulley 51 through rotational exertion on the pedals 61 and reciprocal or oscillating exertion on the arms 71. The connecting structures 82 of each linkage 75 in FIGS. 1-10 and 12 are in the form of apertures that receive other structures therethrough, e.g., bearings, axles, spindles, etc. In another embodiment, the linkages 75 and the cranks 62 may be connected to different orbital connections 66 on the arm 65 of the bell crank 63, such that the cranks 62 are each connected to a first orbital connection 66 on the respective bell crank 63 and the linkages 75 are each connected to a second orbital connection 66 on the respective bell crank 63.

The linkages 75 in the embodiment of FIGS. 1-10 and 12 have side edges 79 that extend in the direction of reciprocal movement that are straight and parallel to each other. In other words, each of the linkages 75 extend in straight linear manner between the ends 77, 78. In this configuration, the body of each linkage 75 has a flat surface 80 extending the entire distance between the ends 77, 78 on both the inner and outer sides. It is understood that the linkages 75 may have a ridge and/or recess 81 on the inner and outer sides in order to increase rigidity, but such a ridge/recess 81 does not extend to either of the side edges 79 of the linkage 75. This configuration is different from existing linkages, which typically have a lateral bend or similar structure to accommodate for differences in width between the connections to the arms and the connections to the pedals. The resulting structure in FIGS. 1-10 and 12 allows for straight line to be drawn between the connecting structures 82 at the ends 77, 78 that extends on the flat surface(s) 80 for its entire length and/or for a plane to be drawn that intersects both of the connecting structures 82 and passes through both of the edges 79 for the entire distance between the connecting structures 82. In this configuration, all of the force exerted along the length of each linkage 75 is a compressive or tensile force, rather than a shearing force, bending force, or moment that may exist if the linkage 75 was not straight. This results in greater rigidity and efficiency in use as compared to linkages that are not straight, which can waste energy through flexing or bowing, as well as superior feel of synchronization between the movement of the arms 71 and the pedals 61 as compared to linkages with some degree of bend.

In another embodiment, the pulley assembly 50 of FIGS. 1-11 may be incorporated into an exercise bike that does not have an arm assembly 70, or into other types of exercise equipment that utilize one or more pulley assemblies with or without a fan or other type of rotor assembly. Likewise, the arm assembly 70 and linkages 75 of FIGS. 1-10 and 12 may be incorporated into an exercise bike that uses a different type of pulley assembly 50 or does not use a pulley assembly, or into other types of exercise equipment that utilize pivoting arms to drive motion.

In one embodiment, the bike 10 may have a computer system connected to various components of the bike 10 to monitor and/or collect data regarding the operation of the bike 10, as well as to make calculations based on such data. For example, such a computer system may include a rotational sensor to sense rotation speed of the rotor 30, as well as a computer memory for storing data gathered by the rotational sensor and a computer processor for making calculations based on such data, e.g., to calculate virtual distance traveled or calories burned. In one embodiment, the computer system for each individual bike 10 may be calibrated to the power input requirements of that bike 10 (determined through testing and/or calculation), so that calculated calorie expenditure data has increased accuracy. The bike 10 in FIGS. 1-10 includes an interface 19 that is positioned to be viewed and/or manipulated by a user and may include visual output, audio output, and/or buttons or other input device(s) for manipulation.

Figure 13:
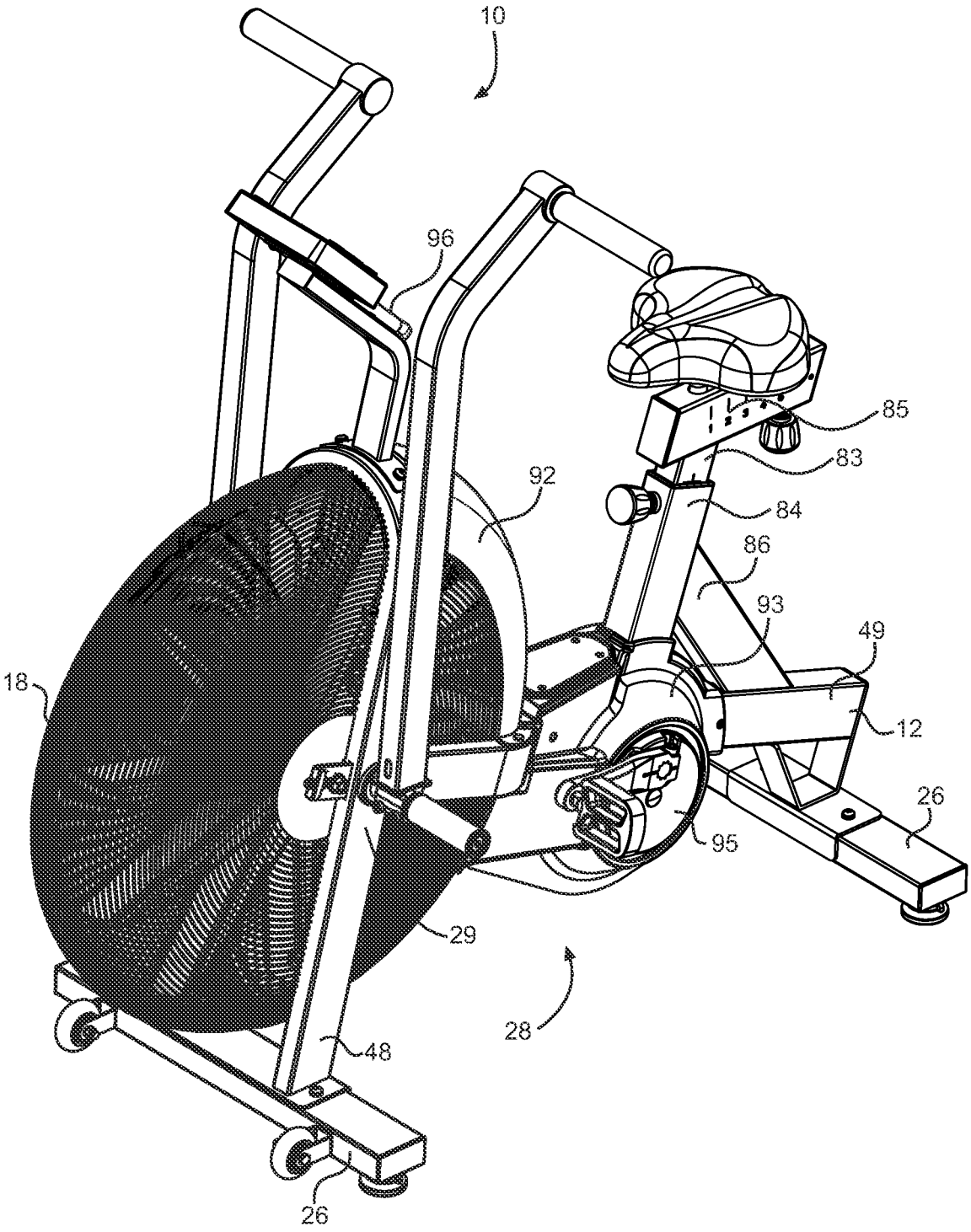
FIG. 13 is a top front perspective view of another embodiment of an exercise bike according to aspects of the disclosure.
Figure 14:
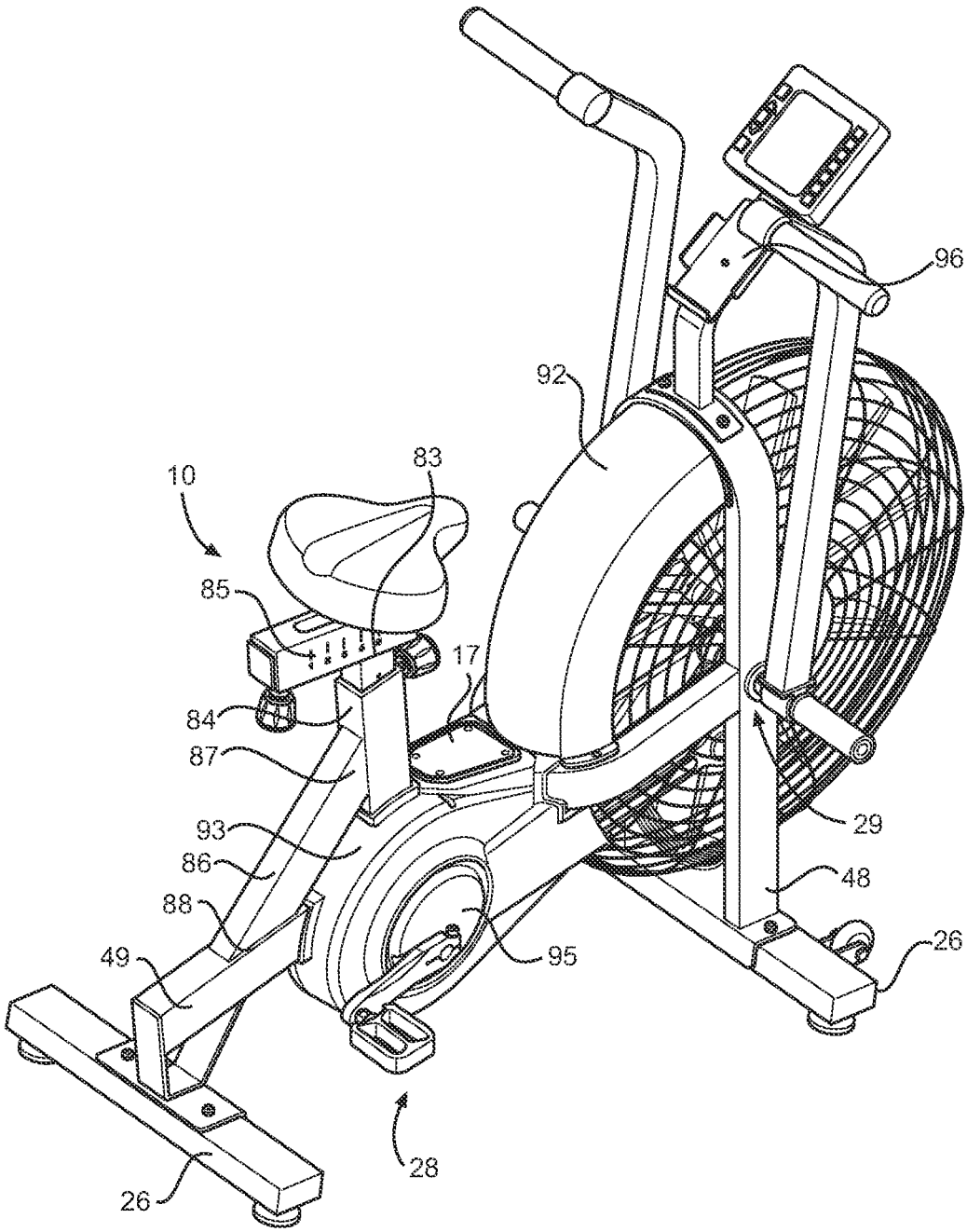
FIG. 14 is a top rear perspective view of the exercise bike of FIG. 13.
Figure 15:
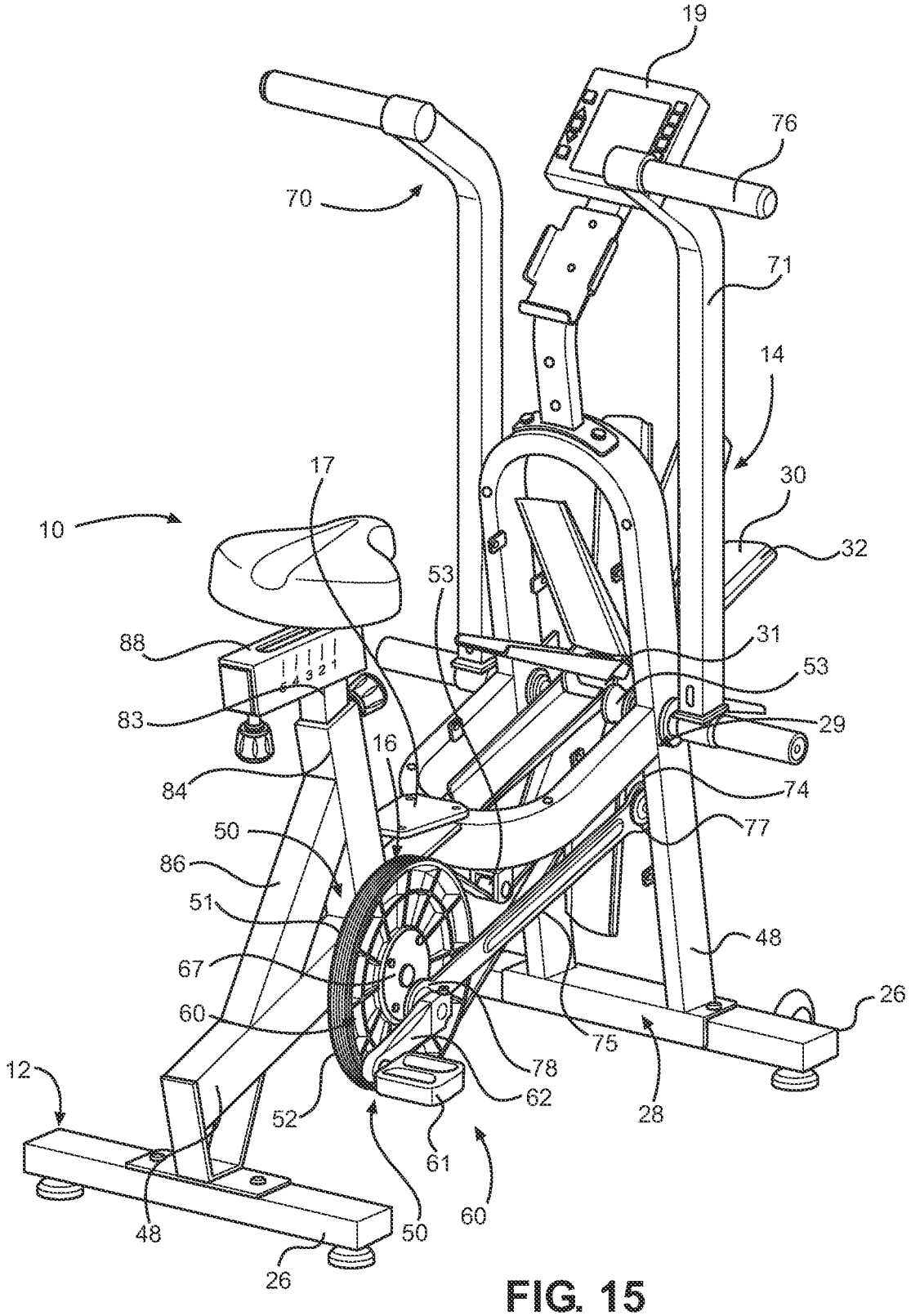
FIG. 15 is a top rear perspective view of the exercise bike of FIG. 13 with some external components removed to show internal detail.
Figure 16:
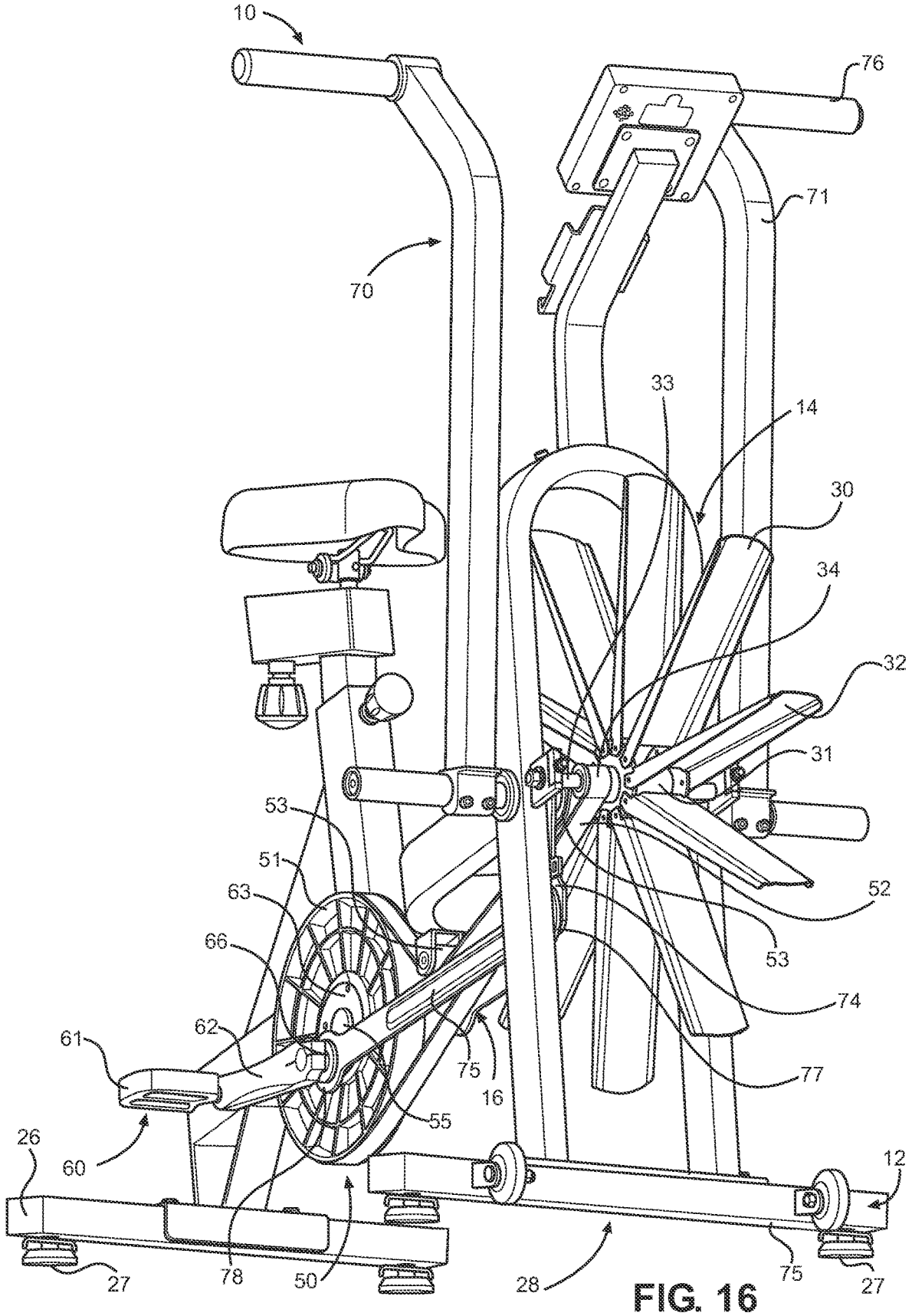
FIG. 16 is a bottom front perspective view of the exercise bike of FIG. 13 with some external components removed to show internal detail.

The bike 10 in FIGS. 1-10 further includes various covers and similar components to guard and/or conceal moving parts of the bike 10. Many of such covers are not shown in FIGS. 5-10 in order to reveal internal detail. For example, the bike 10 includes a rotor cover 18 covering the rotor 30 to protect against contacting the rotor 30 during rotation. The rotor cover 18 is a cage or similar structure with multiple openings permitting air passage, as shown in FIGS. 1-4 and 13-17, that protects the rotor 30 while permitting air displaced by the rotor 30 to flow freely through the rotor cover 18. The rotor cover 18 includes one or more openings or cut-outs 91 to permit the linkages 75 to extend through the rotor cover 18 to link the arm assembly 70 with the pedal assembly 60 and also to permit the belt 52 to extend through the rotor cover 18 to drive rotation of the rotor 30. It is understood that the rotor cover 18 may be formed of two or more pieces that are connected together. The rotor cover 18 in FIGS. 1-10 is formed of three pieces, as is the rotor cover 18 in FIGS. 13-17, and this structure is illustrated most clearly in FIG. 17. The configuration of the rotor cover 18 in this embodiment includes a front piece 18A that forms approximately the front half of the cover 18 and two rear pieces 18B that each form upper and lower rear quarters of the cover 18. This configuration can provide greater stability and ease of connection compared to existing "clamshell" cover configurations. As shown in FIGS. 13-14, the bike 10 may further include an air shield 92 that can be positioned to cover a top rear portion of the rotor cover 18 to prevent air displaced by the rotor 30 from blowing into the face of the user. The air shield 92 can be connected to the frame 12 and/or the rotor cover 18 in this position. In other embodiments, the rotor cover 18 and the air shield 92 may be constructed with similar structural and functional elements having different configurations, including different ornamental appearances.

As another example, the bike 10 may include a pulley cover 93 that covers certain components of the pulley assembly 50 and the pedal assembly 60, as well as portions of the linkages 75. The pulley cover 93 in FIGS. 1-4 is positioned immediately adjacent to the rotor cover 18 and has an opening 94 adjacent the opening 91 of the rotor cover 18 so the linkages 75 can extend directly from the rotor cover 18 into the pulley cover 93 and are not exposed at any point. The pulley cover 93 may be formed of multiple pieces, such as two half pieces each positioned on one side of the input pulley 51. As a further example, the bike 10 may include pedal covers 95 that are positioned to cover the bell cranks 63 of the pedal assembly 60. The pedal covers 95 in FIGS. 1-4 are fixedly engaged with the cranks 62 of the pedal assembly 60 and rotate along with the bell cranks 63. Other covers and similar components may be used in other embodiments. In other embodiments, the pulley cover 93, the pedal covers 95, and other covering components of the bike 10 may be constructed with similar structural and functional elements having different configurations, including different ornamental appearances.

Figure 17:
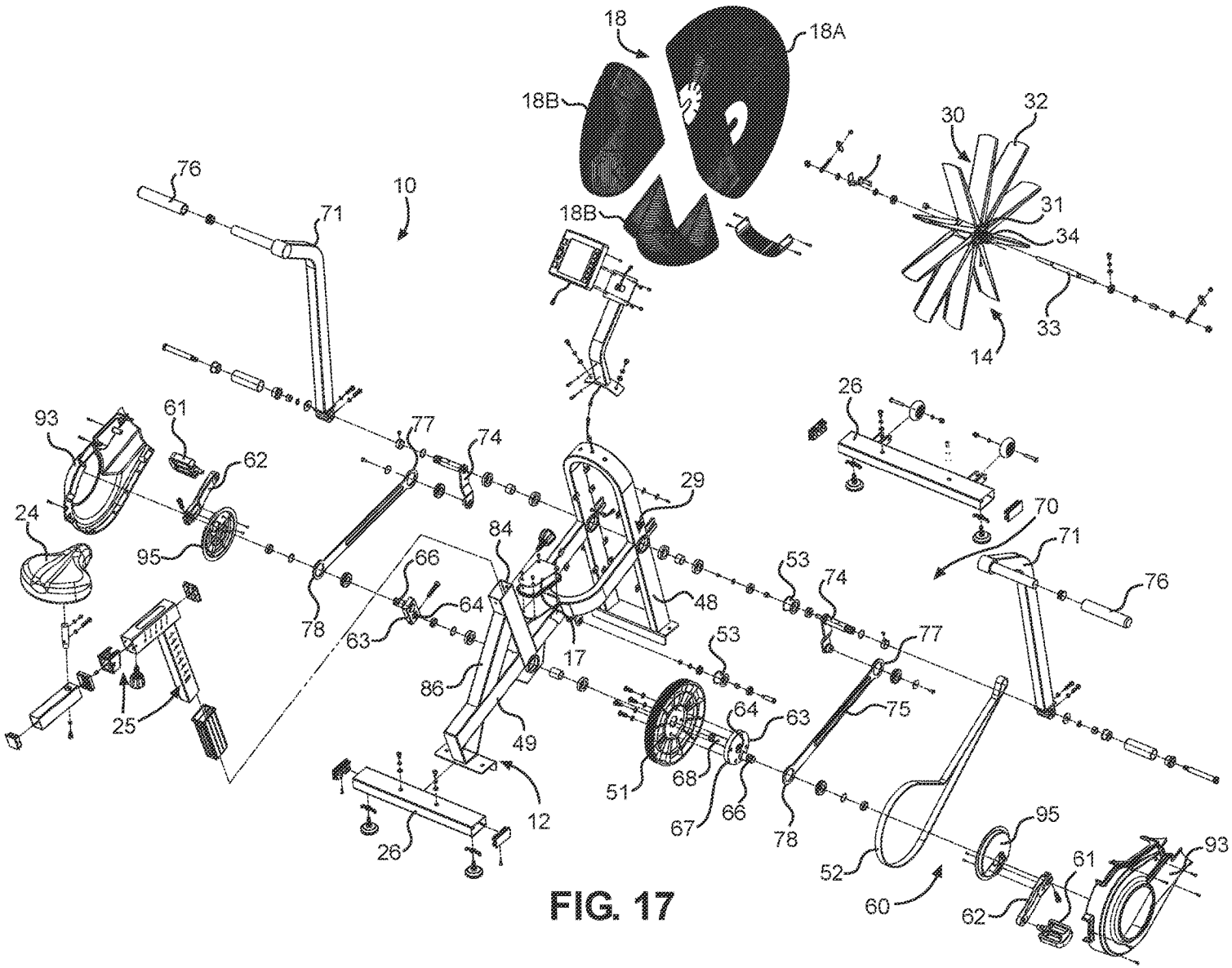
FIG. 17 is an exploded perspective view of the exercise bike of FIG. 17 with some external components removed.
Figure 18:
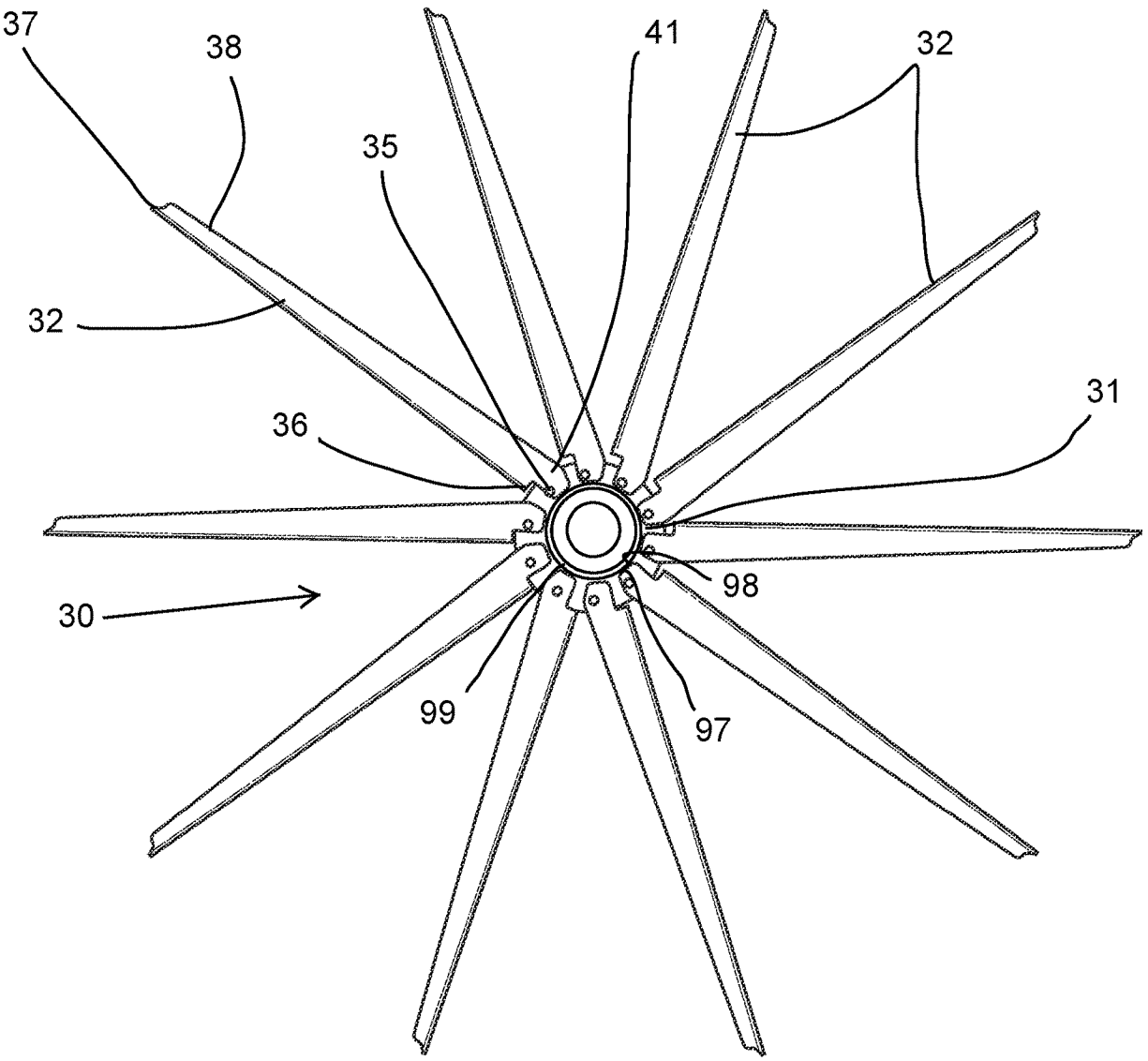
FIG. 18 is a side view of a rotor of the exercise bike of FIG. 17.
Figure 19:
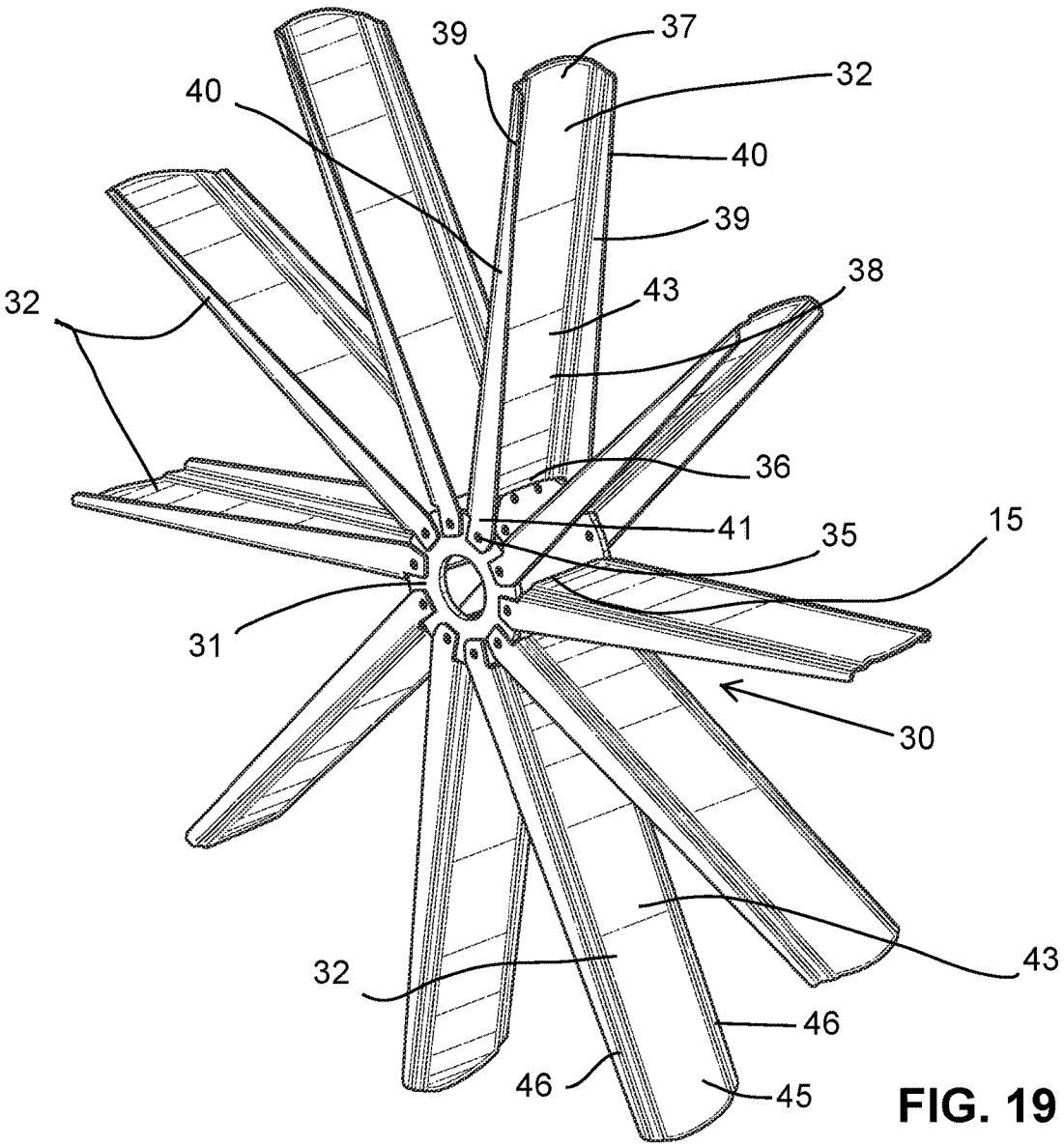
FIG. 19 is a perspective view of the rotor of FIG. 18.

FIGS. 13-24 illustrate another embodiment of the bike 10 that is structurally and functionally identical to the bike 10 of FIGS. 1-12 in most aspects. The bike 10 in FIGS. 13-24 will therefore be described only with respect to the significant differences from the bike 10 in FIGS. 1-12, for the sake of brevity. Any of the features, components, and configurations described herein with respect to FIGS. 13-24 may be used in connection with other embodiments described herein, including the embodiment of FIGS. 1-12, and vice versa. It is understood that any components and features described herein with respect to FIGS. 1-12 are considered to be present in the embodiment of FIGS. 13-24, and vice versa, unless specified otherwise. In the embodiment of FIGS. 13-24, the bike 10 has an air shield 92 as described above connected to the rotor cover 90. Additionally, the bike 10 in FIGS. 13-24 has pedal covers 95 that are ornamentally different from the pedal covers 95 in FIGS. 1-4, as well as other components with ornamental differences. The bike 10 in FIGS. 13-24 further has a device holder 96 configured to hold a mobile device, such as a phone, in an easily visible and accessible position for the user. Another difference between the embodiment of FIGS. 13-24 and the embodiment of FIGS. 1-12 is the structures of the bell cranks 63, which is seen most clearly in FIG. 17. In this embodiment, the bell crank 63 on the side of the frame 12 with the input pulley 51 has a body 67 connected directly to the input pulley 51 and a spindle 68 extending from the body 67 and forming the axle 55 of the input pulley. The body 67 may be considered to constitute the arm 65 of the bell crank 63 as described herein. The spindle 68 also extends through the frame and connects to the bell crank 63 on the opposite side. FIG. 17 does not illustrate the air shield 92 or the device holder 96. A further difference between the embodiment of FIGS. 13-24 and the embodiment of FIGS. 1-12 is the structure of the blades 32 of the rotor 30. The blades 32 of the embodiment of FIGS. 13-24 are shown in greater detail in FIGS. 21-24 and are described below. It is noted that FIG. 17 depicts a number of components that are either not visible or only partially visible in other figures, many of which may not be specifically described herein. FIG. 17 illustrates the location, orientation, and structure of these components, and one skilled in the art would recognize the identity and function of such components.

The blades 32 in the embodiment of FIGS. 13-24 have a stepped or terraced cross-sectional shape and an asymmetrical profile at the distal end 37. The asymmetrical distal end 37 is illustrated most clearly in FIG. 22, where one of the sides 40 (and the flange 39 extending along that side 40) is shorter in length than the longer side 40 and extends farther from the proximal end 36 than the longer side 40. The result of this configuration is that the distal end 37 has an asymmetrical configuration. The distal end 37 in FIG. 22 has a curvilinear arch contour, where the apex of the arch is located off-center and closer to the longer side 40 than the shorter side 40. In other embodiments, the distal end 37 in such an asymmetrical configuration may be straight linear and non-perpendicular to the sides 40, and/or may have a jogged or chamfered configuration, among others.

Figure 21:
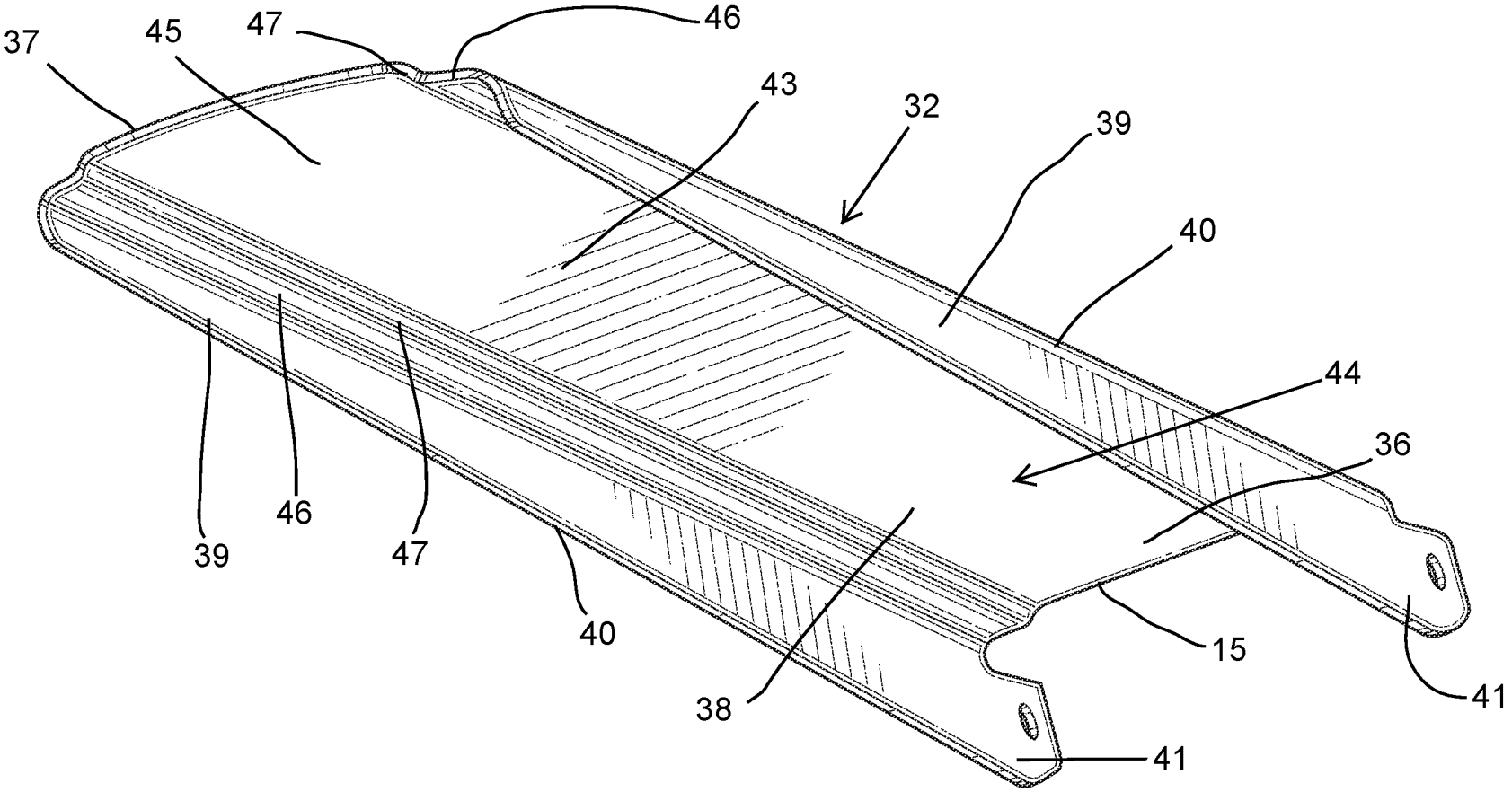
FIG. 21 is a perspective view of a blade of the rotor of FIG. 18.
Figure 22:
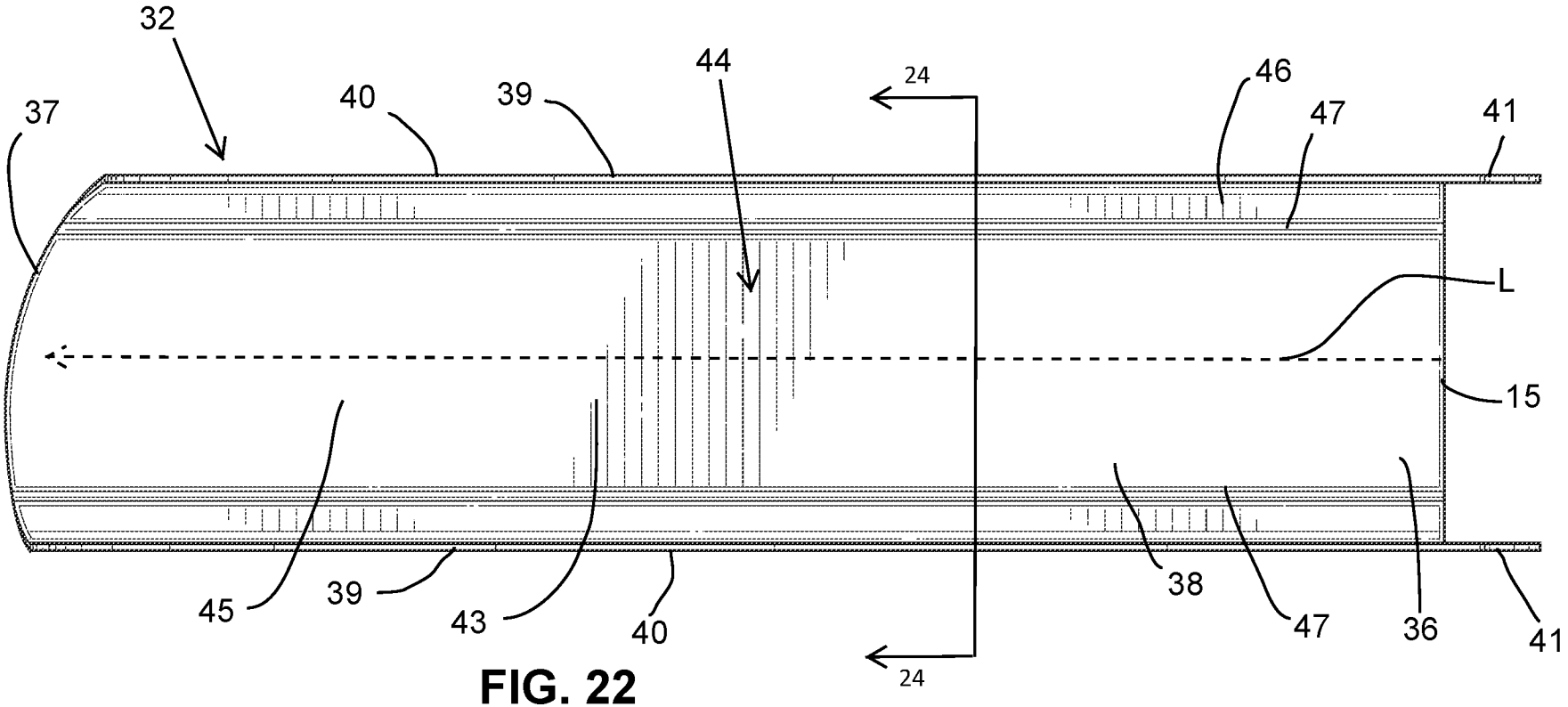
FIG. 22 is a top view of the blade of FIG. 21.
Figure 23:
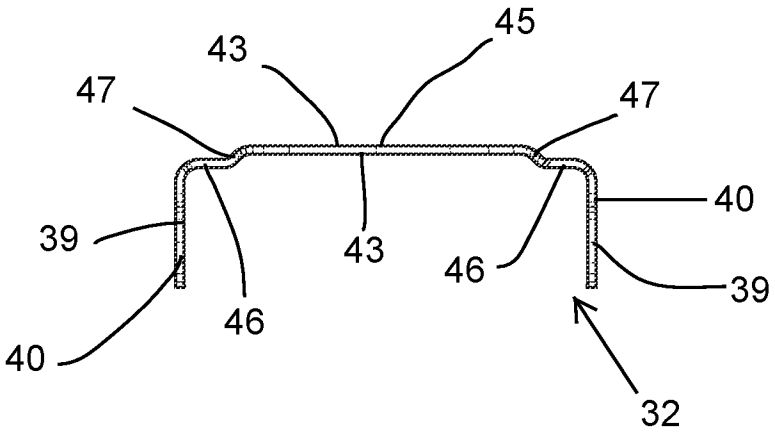
FIG. 23 is an end view of the blade of FIG. 21.

The cross-sectional shape of the blades 32 in FIGS. 13-24 is shown most clearly in FIGS. 21 and 23-24. In a stepped or terraced configuration, one or both surfaces 43 of the blade 32 have a first or upper portion 45 and a second or lower portion 46 that are connected together by one or more shoulders or step portions 47. The upper portion 45, lower portion 46, and step portions 47 all extend longitudinally and are arranged laterally side-by-side in this embodiment. It is understood that "upper" and "lower" as used herein is dependent on orientation, and the present description of the upper and lower portions 45, 46 is made with respect to the orientation shown in FIGS. 23-24. The flanges 39 in this embodiment are positioned at an angle A1 with the upper portion 45 that is approximately 90°. In the embodiment of FIGS. 21 and 23-24, the upper and lower portions 45, 46 are generally planar and parallel to each other, and thus, the angle between the flanges 39 and the lower portions 46 are equivalent to A1 as well. Additionally, the lower portions 46 are parallel and coplanar with each other. The blades 32 in FIGS. 21 and 23-24 are thin sections (with a thickness T that is 1-2 mm, e.g., 1.5 mm), with opposed surfaces 43 that are mirror images of each other. As seen in FIGS. 21 and 23-24, the upper portion 45 is located at the center span or area of the blade 32, with two lower portions 46 extending from the ends of the upper portion 45 to the sides 40 of the blade 32. The upper and lower portions 45, 46 are offset vertically from each other, and the step portions 47 extend from opposite edges of the upper portion 45 to the two lower portions. The step portions 47 extend both outward and downward (relative to the orientation in FIGS. 23-24) from the upper portion 45 to the lower portions 46, and in the configuration illustrated, the step portions 47 form oblique (i.e., non-perpendicular) angles with the upper and lower portions 45, 46. The step portions 47 form angles A2 with the upper portion 45 of 120°-140°, and as shown in FIG. 24, this angle A2 is approximately 129°. In a configuration where the upper and lower portions 45 are parallel to each other, the angle between the lower portions 45 and the step portions 47 are equivalent to A2. The resultant angle A3 between the step portions 47 and the flanges 39 can be represented by the equation A3=A2−A1, and as shown in FIG. 24 where A1 is approximately 90°, this angle A3 is approximately 39°. In another embodiment, the step portions 47 may be angled differently with respect to the upper portion 45 and/or the lower portions 46, including at right angles. The height H of the step portions 47 is defined as the difference in height between the surfaces of the upper and lower portions 45, 46, and may therefore be considered to be equivalent to the degree of vertical offset between the upper and lower portions 45, 46. The height H is 2-3 mm in one embodiment, or approximately 2.5 mm in the embodiment of FIG. 24. In one embodiment, the height H of the step portions 47 is greater than the thickness T of the blade 32. As seen in FIGS. 21 and 22, the upper portion 45, the lower portions 46, and the step portions 47 extend in the longitudinal direction for the entire length of the blade 32, from the proximal end 36 to the distal end 37. This stepped configuration improves the rigidity and flexural stiffness of the blades 32.

The various embodiments of an exercise bike 10 shown and described herein provide advantages over existing exercise bikes and other exercise equipment. The bike 10 has a heavy-duty construction, with greater rigidity and weight in the components of the rotor assembly 14 and the drive assembly 16 as compared to other exercise bikes. For example, the blades 32 of the rotor assembly 14 have greater weight and structures to increase the rigidity and bending stiffness of the blades 32, which creates better feel, less vibration and noise, and more consistent effort throughout the exercise stroke. As another example, the linkages 75 are heavy gauge and straight or planar in form, which reduces energy loss and increases synchronization between the arm assembly 70 and the pedal assembly 60. Other components of the bike 10 provide improved performance, such as the concave structure of the resistance pulleys 53, which is surprisingly found to improve tracking and to keep the belt 52 centered better during use. Still other benefits and advantages are recognizable to those skilled in the art.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "top," "bottom," "front," "back," "side," "rear," "proximal," "distal," and the like, as used herein, are intended for illustrative purposes only and do not limit the embodiments in any way. Nothing in this specification should be construed as requiring a specific three dimensional orientation of structures in order to fall within the scope of this invention, unless explicitly specified by the claims. "Integral joining technique," as used herein, means a technique for joining two pieces so that the two pieces effectively become a single, integral piece, including, but not limited to, irreversible joining techniques such as welding, brazing, soldering, or the like, where separation of the joined pieces cannot be accomplished without structural damage thereto. Additionally, the term "plurality," as used herein, indicates any number greater than one, either disjunctively or conjunctively, as necessary, up to an infinite number. The term "about," as used herein, indicates a variance of +/−10% from the nominal value stated. For quantitative values described herein that do not include decimal points, each digit to the left of the decimal point is considered to be a significant digit. Accordingly, while the specific embodiments have been illustrated and described, numerous modifications come to mind without significantly departing from the spirit of the invention and the scope of protection is only limited by the scope of the accompanying claims.

What is claimed is:

1. An exercise bike comprising:

a frame configured to rest on a ground surface and having a seat configured to support a user;

a rotor supported by the frame, the rotor comprising a hub supported by the frame for rotation on a first axis, and a plurality of blades connected to the hub, wherein the hub and the plurality of blades are configured to rotate together about the first axis, the hub comprising first and second circular plate-like end portions, wherein each of the plurality of blades has a proximal end connected to the hub and an elongated body extending outward in a longitudinal direction from the hub to a distal end, the elongated body extending between the proximal and distal ends and having first and second elongated edges, wherein each blade is connected to the first circular plate-like end portion of the hub at a first connection point proximate the first elongated edge and each blade is connected to the second circular plate-like end portion of the hub at a second connection point proximate the second elongated edge, and wherein each blade has a proximal edge at the proximal end extending parallel to the first axis between the first circular plate-like end portion and the second circular plate-like end portion and a distal edge at the distal end defining a termination point of the respective blade, wherein the elongated body of each blade has opposed upper and lower surfaces defined between the first and second elongated edges, and wherein the upper and lower surfaces are flat within an area defined between the proximal edge, the distal edge, the first elongated edge, and the second elongated edge; and a drive assembly including a pedal assembly supported by the frame and operably connected to the rotor to drive rotation of the rotor, an arm assembly supported by the frame and operably connected to the rotor to drive rotation of the rotor by reciprocating action, and a pulley assembly supported by the frame and operably connected to the rotor, wherein the pedal assembly is connected to the pulley assembly to drive rotation of the rotor through the pulley assembly, and the arm assembly is connected to the pedal assembly to drive rotation of the rotor through the pedal assembly and the pulley assembly.

2. The exercise bike of claim 1, wherein the hub further comprises a cylindrical center body extending axially between the first and second circular plate-like end portions, the center body having a smaller diameter than the first and second circular plate-like end portions, and wherein the proximal edge is spaced from the center body of the hub between the first and second connection points.

3. The exercise bike of claim 1, wherein the distal edges of the plurality of blades define a maximum diameter of the rotor.

4. The exercise bike of claim 1, wherein the distal end of each of the plurality of blades is a free end.

5. The exercise bike of claim 1, wherein the rotor further comprises a mounting structure connecting the plurality of blades to the hub, and wherein the hub and the mounting structure connecting the plurality of blades to the hub form a sole support structure for the plurality of blades.

6. The exercise bike of claim 1, wherein the rotor further comprises a sprocket operably connected to the hub to rotate with the hub about the first axis and operably engaged with the pulley assembly, and wherein 70-90% of a weight of the rotor is located within 75% of a maximum diameter of the rotor.

7. The exercise bike of claim 6, wherein 50-70% of the weight of the rotor is located within 50% of the maximum diameter of the rotor.

8. The exercise bike of claim 6, wherein 30-50% of the weight of the rotor is located within 25% of the maximum diameter of the rotor.

9. The exercise bike of claim 1, wherein the rotor further comprises a sprocket operably connected to the hub to rotate with the hub about the first axis and operably engaged with the pulley assembly, and wherein the rotor has a partial moment of inertia of 38-56% located within 75% of the maximum diameter of the rotor.

10. The exercise bike of claim 1, wherein the rotor further comprises a sprocket operably connected to the hub to rotate with the hub about the first axis and operably engaged with the pulley assembly, wherein the plurality of blades includes 8-12 blades, and the rotor has a total weight of 9-11 pounds, and wherein each of the plurality of blades weighs 0.6-1.0 lb.

11. The exercise bike of claim 1, wherein each of the plurality of blades has a width measured between the first and second elongated edges that is constant from the proximal end to the distal end.

12. The exercise bike of claim 1, wherein each of the plurality of blades is formed as a single, integral piece.

13. The exercise bike of claim 1, wherein each of the plurality of blades further comprises a first flange connected to the elongated body and extending from the elongated body transverse to the upper and lower surfaces, wherein the first flange extends along the first elongated edge of the respective blade, the first flange has a first extension extending outward in the longitudinal direction from the proximal end of the elongated body to form a first mount that is contiguous with the first flange, and wherein the first mount is connected to the first plate-like end portion to connect the respective blade to the hub.

14. The exercise bike of claim 13, wherein each of the plurality of blades further comprises a second flange extending transverse to the upper and lower surfaces along the second elongated edge, wherein the second flange has a second extension extending outward in the longitudinal direction from the proximal end of the elongated body to form a second mount that is contiguous with the second flange, and wherein the second mount is connected to the second plate-like end portion to connect the respective blade to the hub.

15. The exercise bike of claim 1, wherein each of the plurality of blades has a first engagement surface spaced from a connection point between the respective blade and the first plate-like end portion, and the hub has a complementary engagement surface that engages the first engagement surface of the respective blade to resist pivoting of the blade about the connection point.

16. The exercise bike of claim 15, wherein each of the plurality of blades also has a second engagement surface spaced from the second connection point between the respective blade and the second circular plate-like end portion, and the hub further has a second complementary engagement surface that engages the second engagement surface of each blade to resist pivoting of the respective blade about the second connection point.

17. An exercise bike comprising:

a frame configured to rest on a ground surface and having a seat configured to support a user;

a rotor supported by the frame, the rotor comprising a hub supported by the frame for rotation on a first axis, a sprocket operably connected to the hub to rotate with the hub about the first axis, and a plurality of blades connected to the hub, wherein the hub and the plurality of blades are configured to rotate together about the first axis, the hub comprising first and second circular plate-like end portions, wherein each of the plurality of blades is formed as a single, integral piece and has a proximal end connected to the hub and an elongated body extending outward in a longitudinal direction from the hub to a distal end forming a free end of the respective blade, the elongated body extending between the proximal and distal ends and having first and second elongated edges, wherein each blade has a width measured between the first and second elongated edges that is constant from the proximal end to the distal end, and wherein 70-90% of a weight of the rotor is located within 75% of a maximum diameter of the rotor, wherein each blade is connected to the first circular plate-like end portion of the hub at a first connection point proximate the first elongated edge and each blade is connected to the second circular plate-like end portion of the hub at a second connection point proximate the second elongated edge, and wherein each blade has a proximal edge at the proximal end extending parallel to the first axis between the first circular plate-like end portion and the second circular plate-like end portion and a distal edge at the distal end defining a termination point of the respective blade, such that the distal edges of the plurality of blades define a maximum diameter of the rotor, wherein the elongated body of each blade has opposed upper and lower surfaces defined between the first and second elongated edges, and wherein the upper and lower surfaces are flat within an area defined between the proximal edge, the distal edge, the first elongated edge, and the second elongated edge; and a drive assembly including a pedal assembly supported by the frame and operably connected to the rotor to drive rotation of the rotor, an arm assembly supported by the frame and operably connected to the rotor to drive rotation of the rotor by reciprocating action, and a pulley assembly supported by the frame and operably connected to the sprocket of the rotor, wherein the pedal assembly is connected to the pulley assembly to drive rotation of the rotor through the pulley assembly, and the arm assembly is connected to the pedal assembly to drive rotation of the rotor through the pedal assembly and the pulley assembly.

18. The exercise bike of claim 17, wherein 50-70% of the weight of the rotor is located within 50% of the maximum diameter of the rotor, and 30-50% of the weight of the rotor is located within 25% of the maximum diameter of the rotor.

19. The exercise bike of claim 17, wherein the rotor has a partial moment of inertia of 38-56% located within 75% of the maximum diameter of the rotor.

20. The exercise bike of claim 17, wherein the plurality of blades includes 8-12 blades, and the rotor has a total weight of 9-11 pounds, and wherein each of the plurality of blades weighs 0.6-1.0 lb.

* * * * *